US007600939B2

(12) United States Patent
Liu et al.

(10) Patent No.: US 7,600,939 B2
(45) Date of Patent: Oct. 13, 2009

(54) RING BINDER MECHANISM WITH SLIDING HINGE PLATE

(75) Inventors: Zhong Bin Liu, XiDu Town (CN); Hung Yu Cheng, Hong Kong (CN)

(73) Assignee: World Wide Stationery Mfg. Co., Ltd., Kwai Chung, New Territory (HK)

( * ) Notice: Subject to any disclaimer, the term of this patent is extended or adjusted under 35 U.S.C. 154(b) by 54 days.

(21) Appl. No.: 11/745,483

(22) Filed: May 8, 2007

(65) Prior Publication Data

US 2008/0080926 A1 Apr. 3, 2008

Related U.S. Application Data

(63) Continuation-in-part of application No. 11/536,486, filed on Sep. 28, 2006.

(51) Int. Cl.
*B42F 3/02* (2006.01)
*B42F 13/02* (2006.01)

(52) U.S. Cl. ..... 402/19; 402/26; 402/36; 402/41

(58) Field of Classification Search ..... 402/19, 402/20, 26, 31, 35, 37, 38, 39, 46, 55, 56, 402/80 R, 502, 36, 70, 73
See application file for complete search history.

(56) References Cited

U.S. PATENT DOCUMENTS 683,019 A 9/1901 Buchanan
692,584 A 2/1902 Adams
724,849 A 4/1903 Gresham
763,176 A 6/1904 Gresham et al.
778,992 A 1/1905 Nelson
792,389 A 6/1905 Boehner
812,397 A 2/1906 Boehner
840,949 A 1/1907 Mendenhall (Continued)

FOREIGN PATENT DOCUMENTS

FR 1336765 9/1963

(Continued)

OTHER PUBLICATIONS

Office Action dated Jan. 13, 2009 from related U.S. Appl. No. 11/536,486, 12 pgs.

(Continued)

*Primary Examiner*—Dana Ross
*Assistant Examiner*—Jamila Williams
(74) *Attorney, Agent, or Firm*—Senniger Powers

(57) ABSTRACT

A ring binder mechanism includes a housing and first and second hinge plates supported by the housing for pivoting movement relative thereto. A first ring member is mounted on the first hinge plate and moveable with the pivoting motion of the first hinge plate relative to a second ring member between a closed position and an opened position. An interlocking formation locks the first ring member and second ring member in the closed position. An actuator is mounted on the housing for movement relative to the housing. The actuator is adapted to pivot the first and second hinge plates and to translate the first hinge plate relative to the second hinge plate in a direction substantially parallel to a longitudinal axis of the housing.

15 Claims, 42 Drawing Sheets

U.S. PATENT DOCUMENTS

| | | | | | |
|---|---|---|---|---|---|
| 842,851 | A | | 2/1907 | Boden | |
| 857,377 | A | | 6/1907 | Baker | |
| 901,076 | A | | 10/1908 | Dawson | |
| 904,618 | A | | 11/1908 | Kellner | |
| 936,448 | A | | 10/1909 | Hamacher | |
| 968,657 | A | | 8/1910 | Hamacher | |
| 974,831 | A | | 11/1910 | Scherzinger | |
| 1,020,561 | A | | 3/1912 | Krumming | |
| 1,105,196 | A | | 7/1914 | Hanke | |
| 1,163,179 | A | | 12/1915 | Schade, Jr. | |
| 1,165,766 | A | | 12/1915 | Elder | |
| 1,231,816 | A | | 7/1917 | Vesterling | |
| 1,331,226 | A | | 2/1920 | Adams | |
| 1,398,034 | A | | 11/1921 | Mero | |
| 1,398,388 | A | | 11/1921 | Murphy | |
| 1,398,540 | A | | 11/1921 | Day | |
| 1,402,018 | A | | 1/1922 | Schade | |
| 1,473,354 | A | | 11/1923 | Nachtrieb | |
| 1,548,748 | A | | 8/1925 | Riley | |
| 1,610,985 | A | | 12/1926 | Vea | |
| 1,733,548 | A | | 10/1929 | Martin | |
| 1,733,894 | A | | 10/1929 | Martin | |
| 1,765,353 | A | | 6/1930 | Myers | |
| 1,787,957 | A | | 1/1931 | Schade | |
| 1,797,447 | A | | 3/1931 | Savidge | |
| 1,816,021 | A | | 7/1931 | Meyerson | |
| 1,919,784 | A | | 7/1933 | Freiberg | |
| 1,932,874 | A | | 10/1933 | Adams | |
| 1,991,362 | A | | 2/1935 | Krag | |
| 1,996,463 | A | * | 4/1935 | Dawson et al. | 402/38 |
| 2,013,416 | A | | 9/1935 | McClure | |
| 2,020,129 | A | * | 11/1935 | Wedge | 402/30 |
| 2,024,461 | A | | 12/1935 | Lotter | |
| 2,030,473 | A | * | 2/1936 | Schade | 402/38 |
| 2,075,766 | A | | 3/1937 | Rand | |
| 2,077,677 | A | | 4/1937 | Dawson | |
| 2,088,431 | A | | 7/1937 | Newman | |
| 2,089,211 | A | | 8/1937 | Krag | |
| 2,096,944 | A | | 10/1937 | Unger et al. | |
| 2,104,046 | A | | 1/1938 | Krag | |
| 2,105,235 | A | * | 1/1938 | Schade | 402/38 |
| 2,119,639 | A | | 6/1938 | Lotter | |
| 2,158,056 | A | | 5/1939 | Cruzan | |
| 2,179,627 | A | * | 11/1939 | Handler | 402/33 |
| 2,204,918 | A | | 6/1940 | Trussell | |
| 2,218,105 | A | | 10/1940 | Griffin | |
| 2,236,321 | A | | 3/1941 | Ostrander | |
| 2,239,121 | A | | 4/1941 | St. Louis et al. | |
| 2,252,422 | A | | 8/1941 | Unger | |
| 2,260,929 | A | | 10/1941 | Bloore | |
| 2,268,431 | A | | 12/1941 | Slonneger | |
| 2,288,189 | A | | 6/1942 | Guinane | |
| 2,304,716 | A | | 12/1942 | Supin | |
| 2,311,492 | A | | 2/1943 | Unger | |
| 2,311,620 | A | | 2/1943 | Murphy | |
| 2,322,595 | A | | 6/1943 | Schade | |
| 2,389,115 | A | | 11/1945 | Anderson | |
| 2,421,799 | A | | 6/1947 | Martin | |
| 2,460,718 | A | | 2/1949 | Stevens | |
| 2,528,866 | A | | 11/1950 | Dawson, Jr. | |
| 2,543,866 | A | | 3/1951 | Panfil | |
| 2,548,618 | A | * | 4/1951 | Purvis | 402/55 |
| 2,612,169 | A | | 9/1952 | Segal | |
| 2,645,227 | A | | 7/1953 | Segal | |
| 2,664,897 | A | | 1/1954 | Derringer | |
| 2,711,555 | A | | 6/1955 | Hanson | |
| 2,715,906 | A | * | 8/1955 | Lucchesi | 402/20 |
| 2,865,377 | A | | 12/1958 | Schroer et al. | |
| 2,871,711 | A | | 2/1959 | Stark | |
| 2,891,553 | A | | 6/1959 | Acton | |
| 3,077,888 | A | | 2/1963 | Thieme | |
| 3,098,489 | A | | 7/1963 | Vernon | |
| 3,098,490 | A | | 7/1963 | Wance | |
| 3,104,667 | A | | 9/1963 | Mintz | |
| 3,135,266 | A | | 6/1964 | Bouhier | |
| 3,149,636 | A | | 9/1964 | Rankin | |
| 3,190,293 | A | | 6/1965 | Schneider et al. | |
| 3,205,894 | A | | 9/1965 | Rankin | |
| 3,205,895 | A | | 9/1965 | Johnson | |
| 3,246,653 | A | | 4/1966 | Sexton | |
| 3,253,842 | A | | 5/1966 | Rabe | |
| 3,255,759 | A | * | 6/1966 | Dennis | 402/30 |
| 3,331,373 | A | | 7/1967 | Lohmeier | |
| 3,348,550 | A | | 10/1967 | Wolf et al. | |
| 3,718,402 | A | | 2/1973 | Schade | |
| 3,728,036 | A | | 4/1973 | Cott | |
| 3,748,051 | A | | 7/1973 | Frank | |
| 3,827,111 | A | | 8/1974 | O'Connell | |
| 3,833,308 | A | | 9/1974 | Seaborn | |
| 3,884,586 | A | | 5/1975 | Michaelis et al. | |
| 3,954,343 | A | | 5/1976 | Thomsen | |
| 3,993,374 | A | | 11/1976 | Schudy et al. | |
| 4,127,340 | A | | 11/1978 | Almgren | |
| 4,130,368 | A | | 12/1978 | Jacoby et al. | |
| 4,308,637 | A | | 1/1982 | Kucera | |
| 4,352,582 | A | | 10/1982 | Eliasson | |
| 4,415,290 | A | | 11/1983 | Ohminato | |
| 4,486,112 | A | | 12/1984 | Cummins | |
| 4,522,526 | A | | 6/1985 | Lozfau | |
| 4,551,118 | A | | 11/1985 | Spisz | |
| 4,566,817 | A | | 1/1986 | Barrett, Jr. | |
| 4,571,108 | A | | 2/1986 | Vogl | |
| 4,607,970 | A | | 8/1986 | Heusinkveld | |
| 4,624,595 | A | | 11/1986 | Ohminato | |
| 4,678,357 | A | | 7/1987 | Kissel et al. | |
| 4,690,580 | A | | 9/1987 | Kissel | |
| 4,696,595 | A | | 9/1987 | Pinkney | |
| 4,798,491 | A | | 1/1989 | Lassle | |
| 4,813,803 | A | | 3/1989 | Gross | |
| 4,815,882 | A | * | 3/1989 | Ohminato | 402/34 |
| 4,886,390 | A | | 12/1989 | Silence | |
| 4,904,103 | A | | 2/1990 | Im | |
| 4,919,557 | A | | 4/1990 | Podosek | |
| D317,177 | S | | 5/1991 | Wandemberg-Boschetti | |
| 5,018,896 | A | | 5/1991 | Vanni | |
| 5,116,157 | A | | 5/1992 | Gillum et al. | |
| 5,180,247 | A | | 1/1993 | Yu | |
| 5,201,101 | A | | 4/1993 | Rouser | |
| 5,255,991 | A | | 10/1993 | Sparkes | |
| 5,286,128 | A | | 2/1994 | Gillum | |
| 5,354,142 | A | | 10/1994 | Yu | |
| 5,368,407 | A | | 11/1994 | Law | |
| 5,392,848 | A | * | 2/1995 | Bottcher et al. | 165/164 |
| 5,393,156 | A | | 2/1995 | Mullin et al. | |
| 5,476,335 | A | | 12/1995 | Whaley | |
| 5,660,490 | A | | 8/1997 | Warrington | |
| 5,692,847 | A | * | 12/1997 | Zane et al. | 402/38 |
| 5,692,848 | A | | 12/1997 | Wada | |
| 5,697,722 | A | | 12/1997 | Hladik et al. | |
| 5,718,529 | A | | 2/1998 | Chan | |
| 5,765,956 | A | | 6/1998 | Lanzarin | |
| 5,782,569 | A | | 7/1998 | Mullin et al. | |
| 5,807,006 | A | | 9/1998 | Cheung | |
| 5,810,499 | A | | 9/1998 | Law | |
| 5,816,729 | A | | 10/1998 | Whaley | |
| 5,827,004 | A | | 10/1998 | Kim | |
| 5,868,513 | A | | 2/1999 | Law | |
| 5,895,164 | A | | 4/1999 | Wu | |
| 5,938,365 | A | | 8/1999 | Grewe | |
| 5,975,784 | A | * | 11/1999 | Whaley | 402/34 |
| 5,975,785 | A | | 11/1999 | Chan | |
| 6,036,394 | A | | 3/2000 | Cheng | |
| D430,204 | S | | 8/2000 | Berracasa | |
| 6,109,813 | A | | 8/2000 | To | |

| | | | | |
|---|---|---|---|---|
| 6,155,737 | A | 12/2000 | Whaley | |
| 6,179,508 | B1 | 1/2001 | Coerver | |
| 6,203,229 | B1 | 3/2001 | Coerver | |
| 6,206,601 | B1 | 3/2001 | Ko | |
| 6,217,247 | B1 | 4/2001 | Ng | |
| 6,270,279 | B1 | 8/2001 | Whaley | |
| 6,270,280 | B1 | 8/2001 | Baumann | |
| 6,276,862 | B1 | 8/2001 | Snyder | |
| 6,293,722 | B1 * | 9/2001 | Holbrook et al. | 402/35 |
| 6,328,497 | B1 | 12/2001 | To | |
| 6,364,558 | B1 | 4/2002 | To | |
| 6,467,984 | B1 | 10/2002 | To | |
| 6,749,357 | B2 | 6/2004 | Cheng | |
| 6,761,497 | B2 | 7/2004 | Kaneda | |
| 6,840,695 | B2 | 1/2005 | Horn | |
| D533,588 | S | 12/2006 | Cheng | |
| 7,275,886 | B2 | 10/2007 | Cheng | |
| 7,293,932 | B2 | 11/2007 | Wong | |
| 7,360,962 | B2 | 4/2008 | To | |
| 2003/0044221 | A1 | 3/2003 | To | |
| 2003/0103798 | A1 | 6/2003 | Cheng et al. | |
| 2003/0123923 | A1 | 7/2003 | Koike | |
| 2004/0013463 | A1 | 1/2004 | To | |
| 2004/0086323 | A1 | 5/2004 | Tanaka | |
| 2005/0013654 | A1 | 1/2005 | Cheng | |
| 2005/0207826 | A1 | 9/2005 | Cheng | |
| 2005/0271459 | A1 | 12/2005 | To | |
| 2006/0153628 | A1 * | 7/2006 | Tanaka et al. | 402/35 |

FOREIGN PATENT DOCUMENTS

| | | | |
|---|---|---|---|
| FR | 1346864 | | 12/1963 |
| FR | 2221924 | | 10/1974 |
| FR | 2238332 | | 2/1975 |
| GB | 868724 | | 5/1961 |
| GB | 906279 | | 9/1962 |
| GB | 952536 | | 3/1964 |
| GB | 2292343 | A | 2/1996 |
| GB | 2387815 | A | 10/2003 |
| JP | 5979379 | | 5/1984 |
| JP | 6118880 | | 2/1986 |
| JP | 1299095 | A | 12/1989 |
| JP | 2034289 | U | 3/1990 |
| JP | 4120085 | | 10/1992 |
| WO | WO 2005035265 | | 4/2005 |

OTHER PUBLICATIONS

Office action dated Jul. 10, 2009 regarding U.S. Appl. No. 11/536,486, 9 pages.

* cited by examiner

RING BINDER MECHANISM WITH SLIDING HINGE PLATE

CROSS REFERENCE TO RELATED APPLICATION

This application is a continuation-in-part of U.S. patent application Ser. No. 11/536,486, filed Sep. 28, 2006, which is hereby incorporated by reference in its entirety.

BACKGROUND

This invention relates generally to ring binder mechanisms for retaining loose-leaf pages, and more specifically to a ring binder mechanism having a hinge plate that slides for unlocking ring members mounted thereon and pivots for moving them to an opened position.

A typical ring binder mechanism retains loose-leaf pages, such as hole-punched papers, in a file or notebook. It generally features multiple rings, each including two half ring members that mount on two adjacent hinge plates. The hinge plates join together about a pivot axis and pivot within an elongated housing, allowing the ring members mounted thereon to move between an opened position where pages may be added or removed, and a closed position where pages are retained and can move along the rings. An operator may typically open or close the ring members by manually pulling the ring members apart or pushing them together. In addition, in some mechanisms the operator can move a lever located at one or both ends of the mechanism to open or close the ring members.

The paired ring members of these known mechanisms often have free ends with tip formations that do not always exactly align when the ring members are closed, and misalignment of the ring members in directions transverse to longitudinal centerlines of the ring members is common. Moreover, even if alignment is initially perfect upon closure, the free ends may still be able to move relative to each other. Accordingly, pages bound by these known mechanisms may not smoothly move from one ring member to the other and may be torn.

It is known to provide paired ring members that have free ends with interlocking tip formations to hold the paired ring members in alignment when they are closed. Examples are shown in U.S. Pat. No. 5,660,490 (Warrington) and U.S. Pat. No. 6,293,722 (Holbrook et al.) and in U.S. Pat. Publ. No. 2006/0153628 (Tanaka et al.). To open these ring members, the interlocking formations must first be disengaged. This is typically accomplished by moving one of the ring members in a direction parallel to a longitudinal axis of the housing relative to the paired ring member. In U.S. Pat. No. 5,660,490 the ring members themselves are flexed in opposite longitudinal directions to disengage the interlocking tip formations. But the ring members can be difficult to manually flex, and they may bend or fatigue and impair accurate alignment. In U.S. Pat. No. 6,293,722 the ring members of each ring are formed as ring assemblies. One of the ring assemblies is mounted on a sliding structure for moving the ring members in a longitudinal direction to disengage the interlocking tip formations. But the complex structures associated with moving ring members in a longitudinal direction can be cost prohibitive for mass producing the mechanisms. In U.S. Pat. Publ. No. 2006/0153628 the ring members are mounted on hinge plates, and the hinge plates slide in opposite longitudinal directions to disengage the interlocking tip formations. But direct manipulation of the ring members as required here often requires two hands to disengage the interlocking tip formations. It would therefore be desirable to provide a ring binder mechanism with locking ring members that is easy to manufacture, simple to use, and durable.

SUMMARY OF THE INVENTION

In one aspect, a ring binder mechanism for retaining loose-leaf pages generally comprises a housing having a longitudinal axis. First and second hinge plates are supported by the housing along a hinge for pivoting movement relative to the housing about the hinge. Rings for holding loose-leaf pages include a first ring member and a second ring member. The first ring member is mounted on the first hinge plate and moveable with the pivoting motion of the first hinge plate relative to the second ring member between a closed position and an opened position. In the closed position, a free end of the first ring member is joined with a free end of the second ring member. In the opened position, the free end of the first ring member is separated from the free end of the second ring member. An interlocking formation locks the first ring member and second ring member of each ring in the closed position. An actuator is mounted on the housing for movement relative to the housing. The actuator is adapted to pivot the first and second hinge plates and to translate the first hinge plate relative to the second hinge plate in a direction substantially parallel to the longitudinal axis of the housing.

Other features of the invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
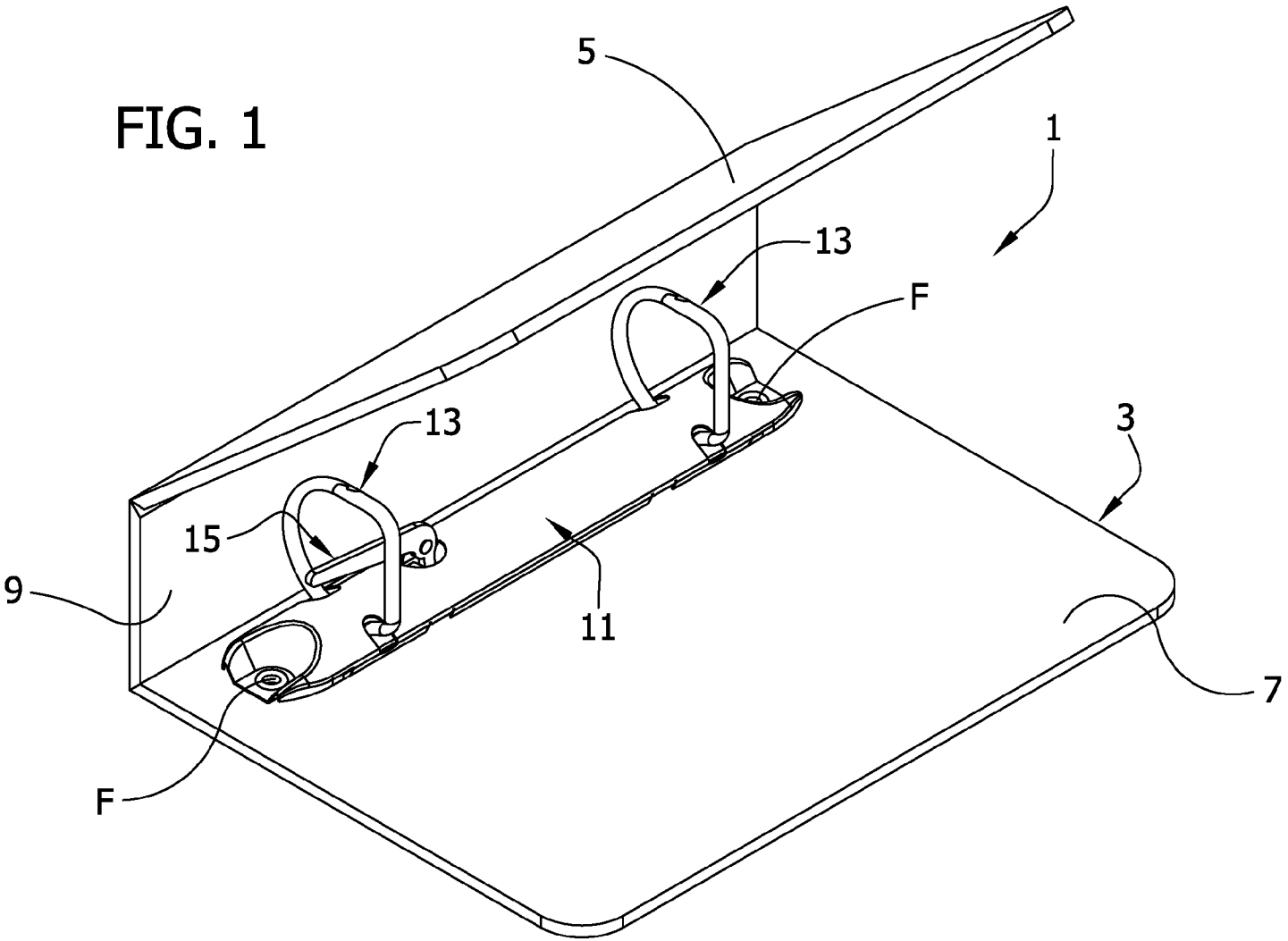
FIG. 1 is a perspective of a ring binder mechanism according to a first embodiment of the invention mounted on a cover of a binder.

Referring now to the drawings, and particularly to FIG. 1, a ring binder mechanism according to the present invention is shown generally at 1. In FIG. 1 the mechanism 1 is shown mounted on a binder indicated generally at 3. The binder 3 includes a front cover 5 and a back cover 7 hingedly attached to a spine 9 so that the covers are movable to selectively cover or expose loose-leaf pages (not shown) retained by the ring binder mechanism 1. Specifically in FIG. 1, the mechanism 1 is shown mounted on the back cover 7 of the binder 3. It is understood that the ring binder mechanism 1 can be affixed on the front cover 5 or the spine 9 within the scope of the invention. In addition, the ring binder mechanism 1 can be mounted other than on a binder without departing from the scope of the invention.

Figure 2:
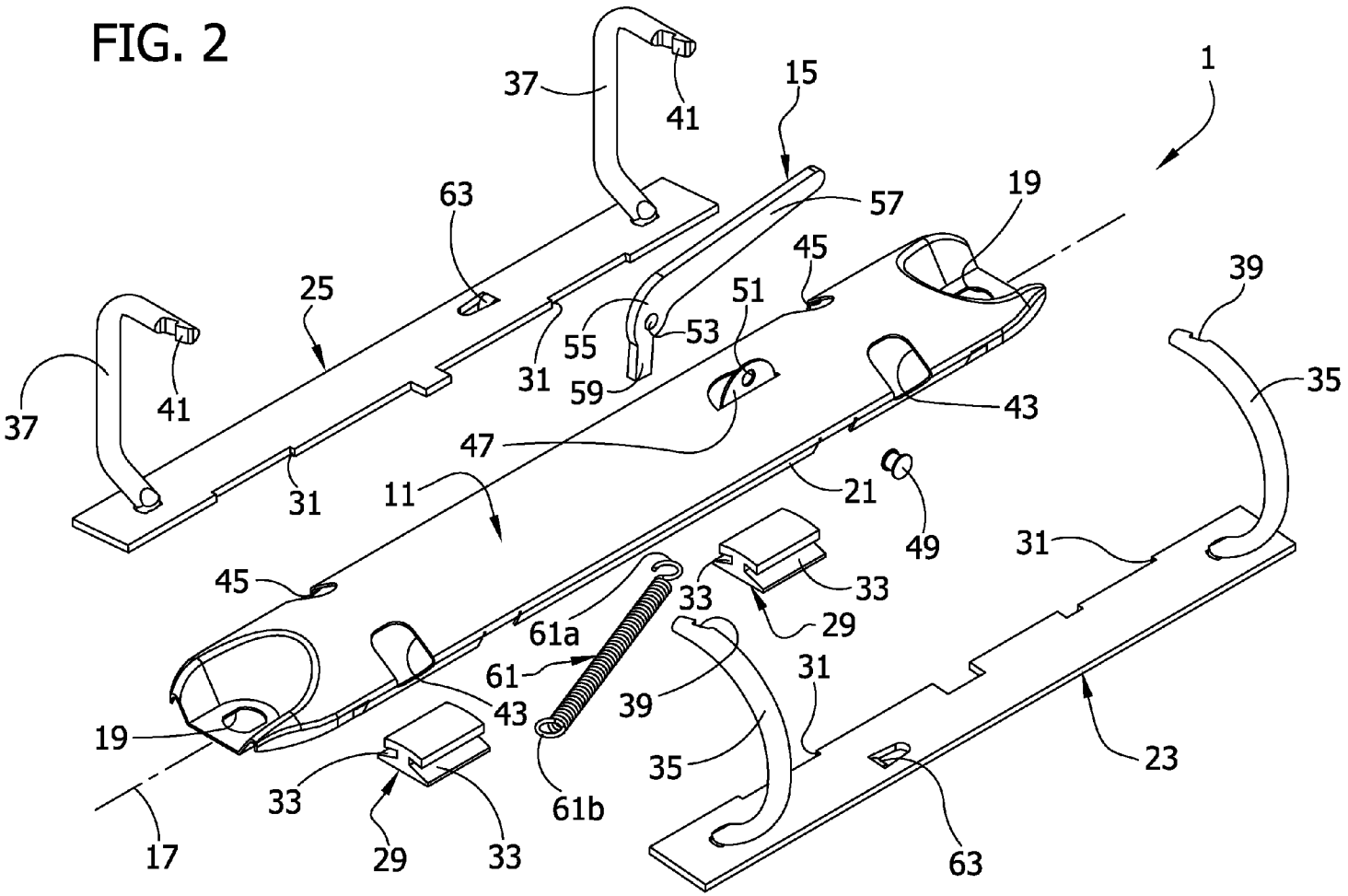
FIG. 2 is an exploded perspective of the ring mechanism.
Figure 3:
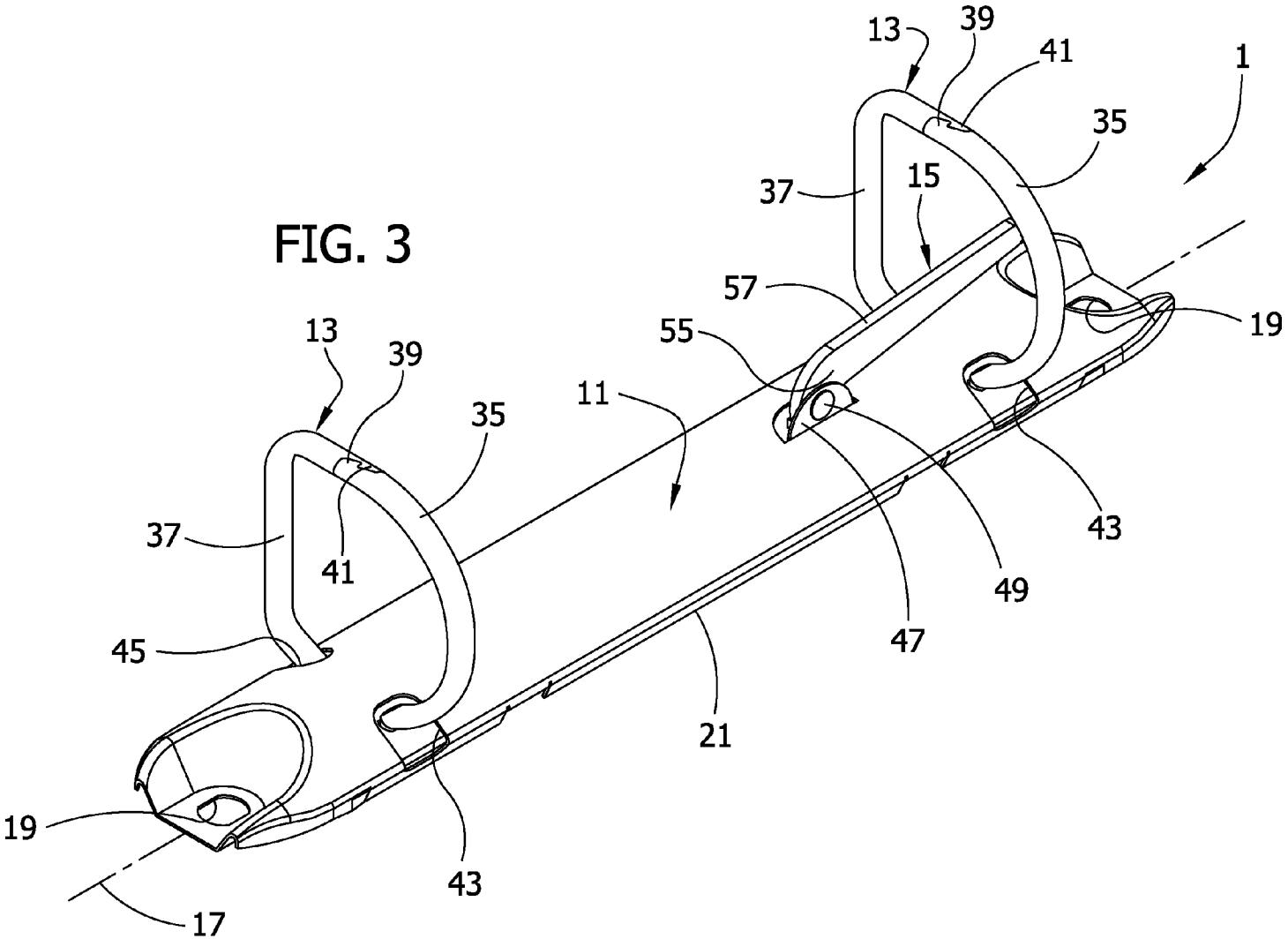
FIG. 3 is a top perspective of the ring mechanism with ring members in a closed position.

With additional reference to FIGS. 2 and 3, the ring binder mechanism 1 generally includes an elongate housing (indicated generally at 11) supporting two rings (each indicated generally at 13) for holding the loose-leaf pages, and an actuating lever (indicated generally at 15, and broadly, "actuator") for opening and closing the rings. The housing 11 is generally symmetrical with a roughly arch-shaped cross section (see also FIG. 6) and includes a longitudinal axis 17. Two circular openings, each indicated at 19, are provided at longitudinal ends of the housing 11 for receiving and attaching fasteners, each indicated at F. to attach the ring mechanism 1 to the binder 3 (FIG. 1). It is envisioned that the housing 11 of the present invention is made of metal, but it may be made of any other suitable material that is sufficiently rigid to provide a stable mount for components of the mechanism 1. In addition, mechanisms having housings of other shapes, including irregular shapes, or housings that are integral with a file or notebook do not depart from the scope of this invention.

Figure 4:
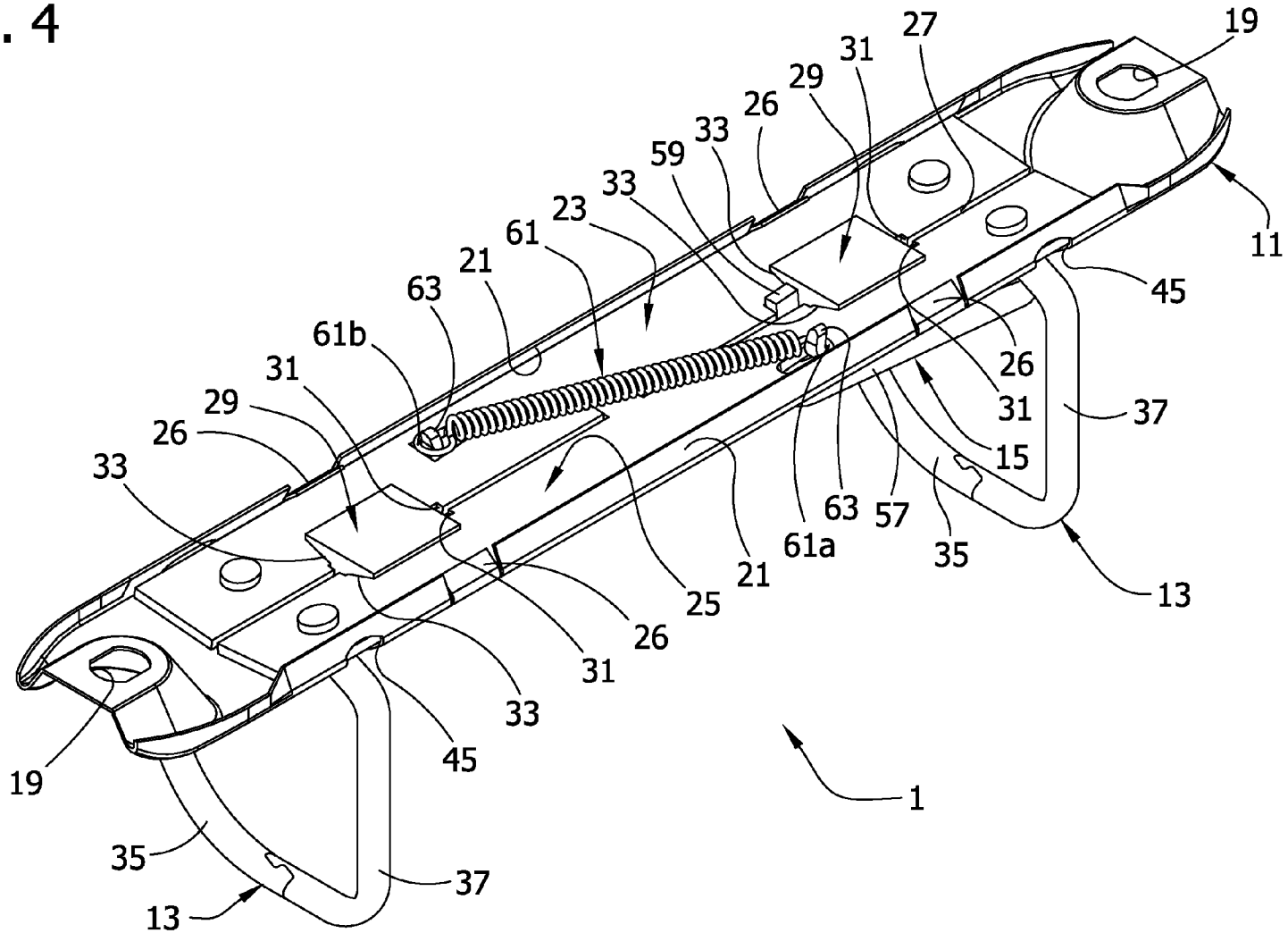
FIG. 4 is a bottom perspective thereof.

With reference to FIGS. 2-4, bent under rims (each indicated at 21) are formed along longitudinal edges of the housing 11 for supporting first and second hinge plates, which are indicated generally at 23, 25 (respectively). Traps 26 are formed in the rims 21 to further secure the hinge plates 23, 25 within the housing 11. The hinge plates 23, 25 are flat, elongate and generally rectangular in shape. As best shown in FIG. 4, the hinge plates 23, 25 are shorter than the housing 11 and are arranged parallel to each other and to the longitudinal axis 17 of the housing below the housing. The hinge plates 23, 25 interconnect along their inner longitudinal edge margins and form a central hinge 27. The rims 21 and traps 26 loosely receive outer longitudinal edge margins of the interconnected hinge plates 23, 25 so that the hinge plates are retained on the housing 11 while the outer longitudinal edge margins are free to move within the rims 21. This allows the hinge plates 23, 25 to pivot about the hinge 27 upward and downward within the housing 11. This also allows the first hinge plate 23 to slide relative to the housing 11 and relative to the second hinge plate 25 in a direction substantially parallel to the longitudinal axis 17 of the housing 11. While in the illustrated mechanism 1 the rims 21 extend the length of the housing 11, rims could be located at spaced-apart locations along the housing 11. Also, rims without traps are within the scope of the invention.

Two friction buffers, each indicated generally at 29, are located between the hinge plates 23, 25 along the central hinge 27. The buffers 29 are roughly I-shaped in cross section. The buffers 29 are received in cutouts 31 in the hinge plates 23, 25 and each include opposing channels (each channel being indicated at 33) for receiving the inner edges of the hinge plates 23, 25 at the cutouts 31 (FIG. 2). The buffers 29 aid pivoting and sliding movement of the hinge plates 23, 25 during operation. More specifically, the opposing channels 33 of the buffers 29 provide an interconnection between the hinge plates 23, 25 at their inner edge margins along the central hinge 27 so that other structure is not necessary to support the hinge plates. This allows the first hinge plate 23 to pivot relative to the second hinge plate 25, and also allows the first hinge plate 23 to slide freely relative to the second hinge plate 25 without obstruction. In addition, the cutouts 31 in the hinge plates 23, 25 are longer than the buffers 29. This provides room at the ends of the cutouts 31 to accommodate translational movement of the first hinge plate 23.

As shown in FIG. 2, the rings 13 each include first and second ring members 35, 37 (respectively) mounted opposite each other on the first and second hinge plates 23, 25 respectively. The ring members 35, 37 move with the pivoting movement of the hinge plates 23, 25 between open and closed positions. Free ends of the first and second ring members 35, 37 include hook-shaped formations 39, 41 shaped to interlock when the ring members are closed. The hook-shaped formations 39, 41 may be broadly collectively referred to as an interlocking formation. The hook-shaped formations 39, 41 can be disengaged by moving one of the ring members 35, 37 (the first ring members 35 in the illustrated mechanism 1) in a direction parallel to the longitudinal axis 17 of the housing 11. It is envisioned that the ring members 35, 37 are formed of a conventional, cylindrical rod of suitable material, such as steel. But it is understood that ring members having a different overall shape or cross section, or ring members made of different material do not depart from the scope of the present invention. Structure used to lock ring members closed but not formed as part of the ring members (e.g., structure blocking the hinge plates from pivoting) may also broadly be referred to as an interlocking formation.

Figure 5:
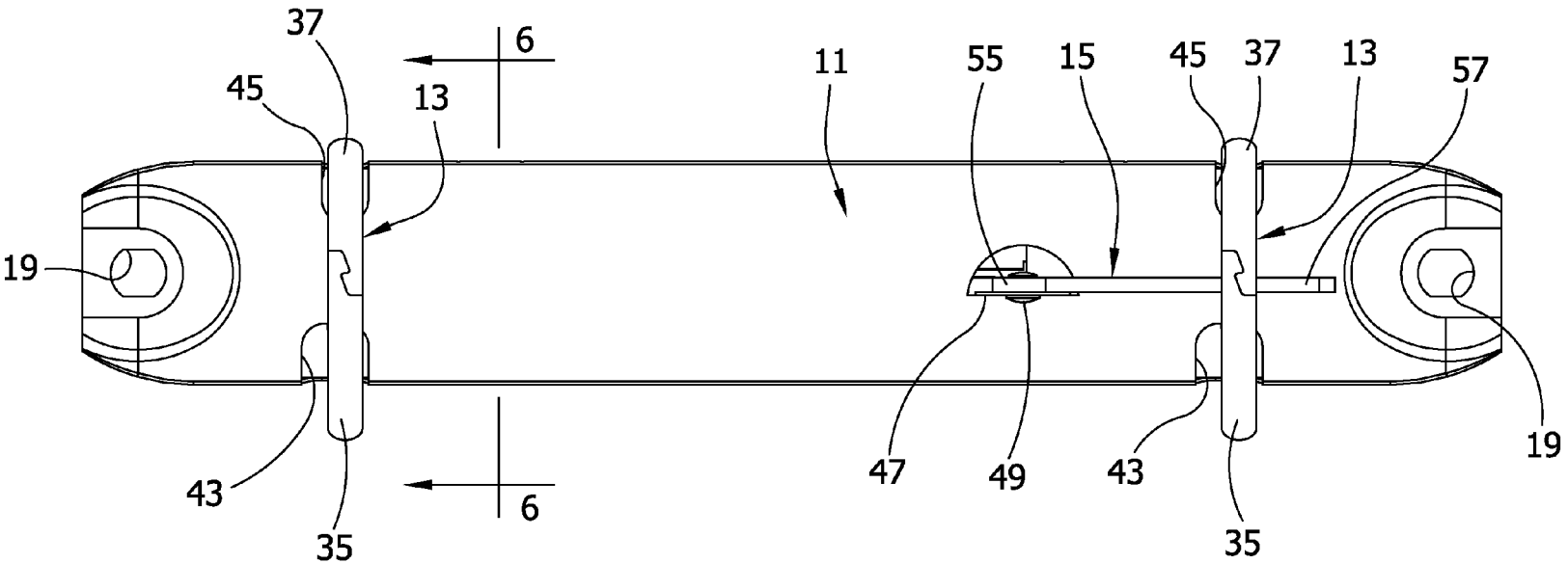
FIG. 5 is a top plan view of the ring mechanism of FIG. 3.

As shown in FIGS. 3-5, the ring members 35, 37 extend through first and second paired slots 43, 45 (respectively) in the housing 11. The first slots 43 receive the first ring members 35 and the second slots 45 receive the second ring members 37. As best shown in FIG. 5, the first and second slots 43, 45 are sized and shaped to allow lateral movement of the ring members 35, 37 (i.e., lateral to the longitudinal axis 17 of the housing 11) relative to the housing when they open and close. The first slots 43 are additionally enlarged in a lengthwise direction of the housing 11 to allow the first ring members 35 to move longitudinally (i.e., slide) with the first hinge plate 23. The second slots 45 are narrower than the first slots 43 and restrict translational movement of the second ring members 37, and thus restrict longitudinal movement of the second hinge plate 25.

Figure 7:
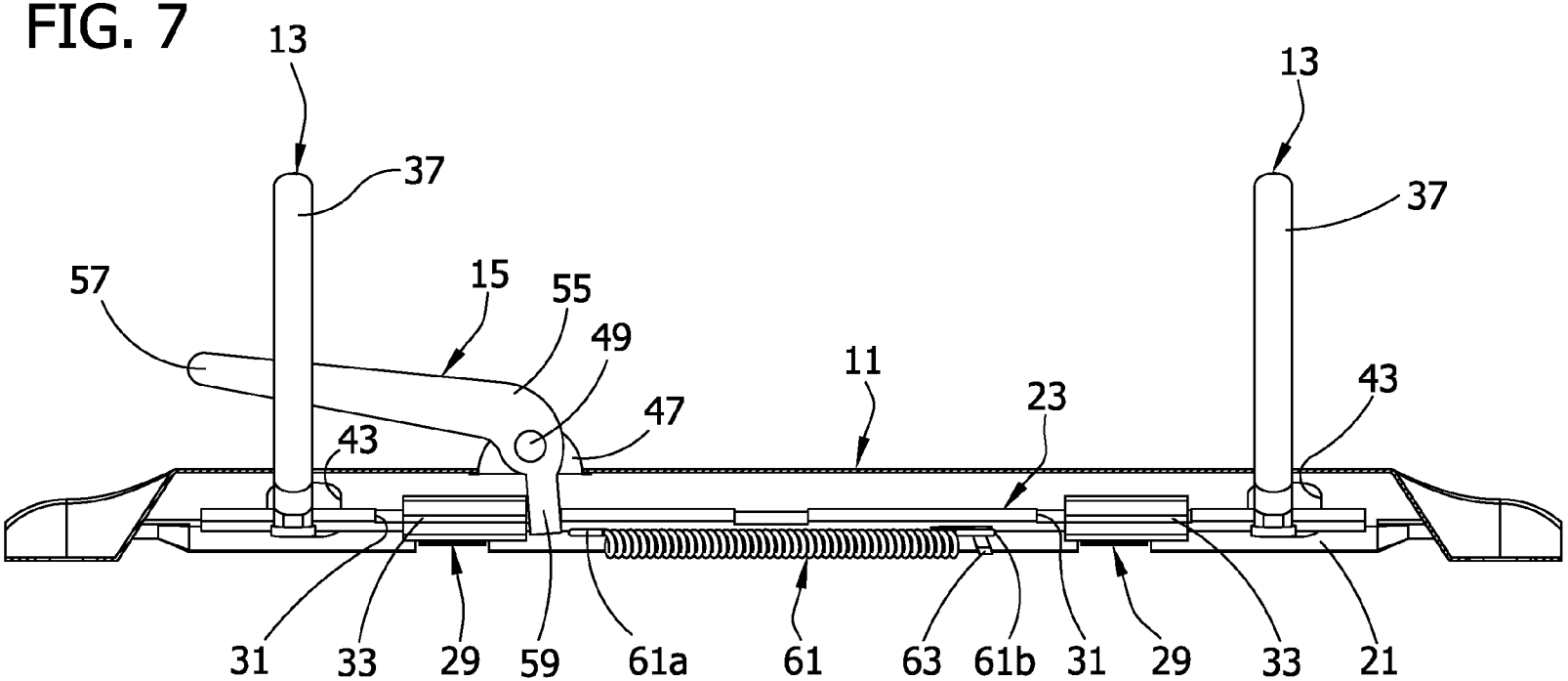
FIG. 7 is a side elevation of the ring mechanism of FIG. 3 with part of the housing cut away and components removed to show internal construction.

As shown in FIGS. 2 and 3, the actuating lever 15 pivotally mounts on an upper surface of the housing 11 between the rings 13 and at an upstanding tab 47 formed in the housing. A mounting pin 49 is received through an opening 51 in the tab 47 and an opening 53 in an elbow 55 of the lever 15 for pivotally attaching the lever to the tab 47. The lever 15 is generally L-shaped and includes a first arm 57 and a second arm 59 extending generally perpendicular from the elbow 55. The first arm 57 extends toward one end of the housing 11 above the housing 11 and extends through one of the rings 13, placing it in a position for easy access by an operator. The second arm 59 passes through the housing 11 and through the hinge plates 23, 25 and engages the first hinge plate 23 (see also FIG. 7). Preferably, the actuating lever 15 is mounted between the longitudinal ends of the housing 11. The lever 15 may be mounted differently within the scope of the invention.

As shown in FIG. 4 an extension spring, indicated generally at 61, positioned below the hinge plates 23, 25 connects to each hinge plate at a detent 63. More specifically, ends 61*a*, 61*b* of the spring are hook-shaped and connect to the detents 63 of the hinge plates 23, 25. The spring 61 extends across the central hinge 27 and exerts a pulling force on the first hinge plate 23 urging it to a position in which the first and second ring members 35, 37 of each ring 13 are substantially aligned.

Figure 6:
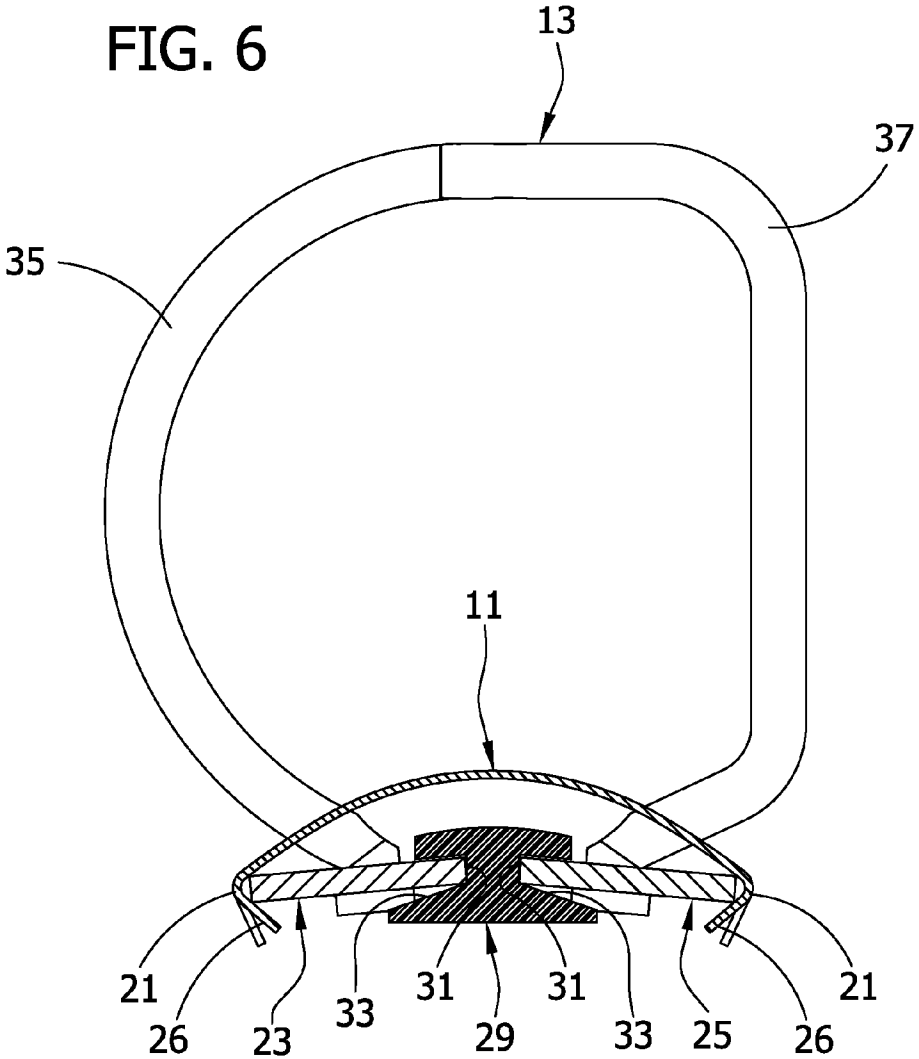
FIG. 6 is a section taken in a plane including line 6-6 of FIG. 5.
Figure 11:
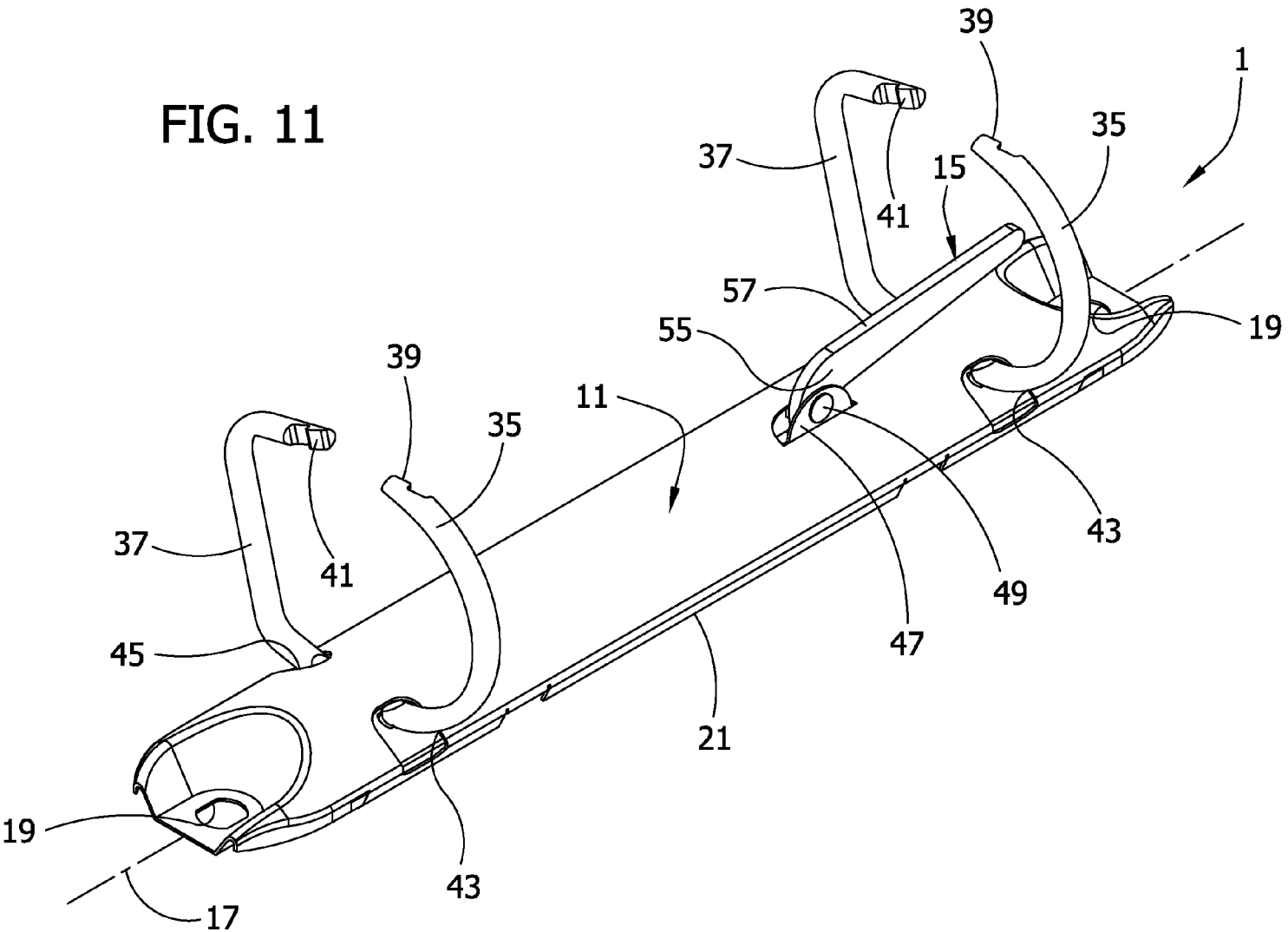
FIG. 11 is a top perspective of the ring mechanism with the ring members in an opened position.
Figure 12:
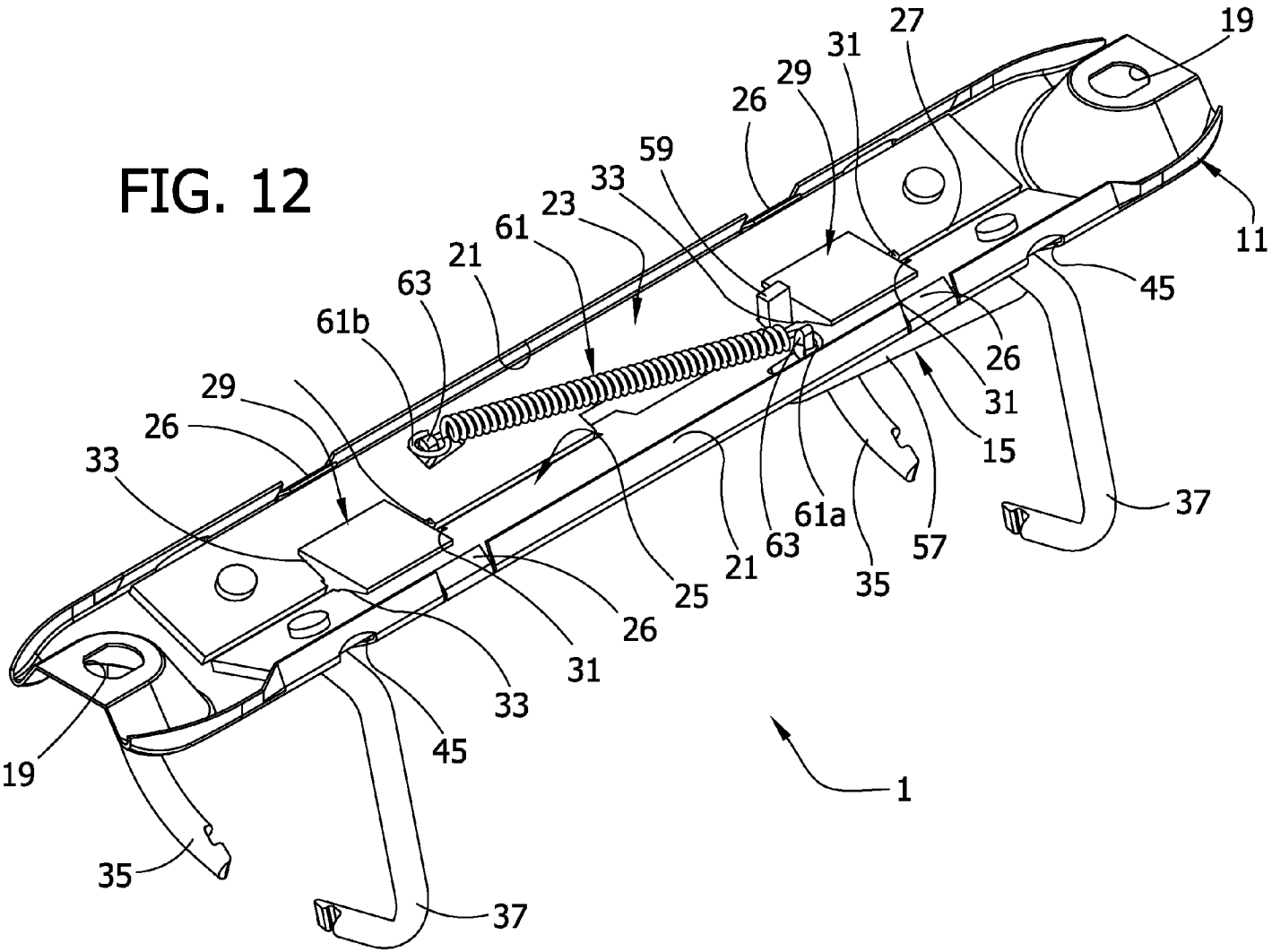
FIG. 12 is a bottom perspective thereof.
Figure 13:
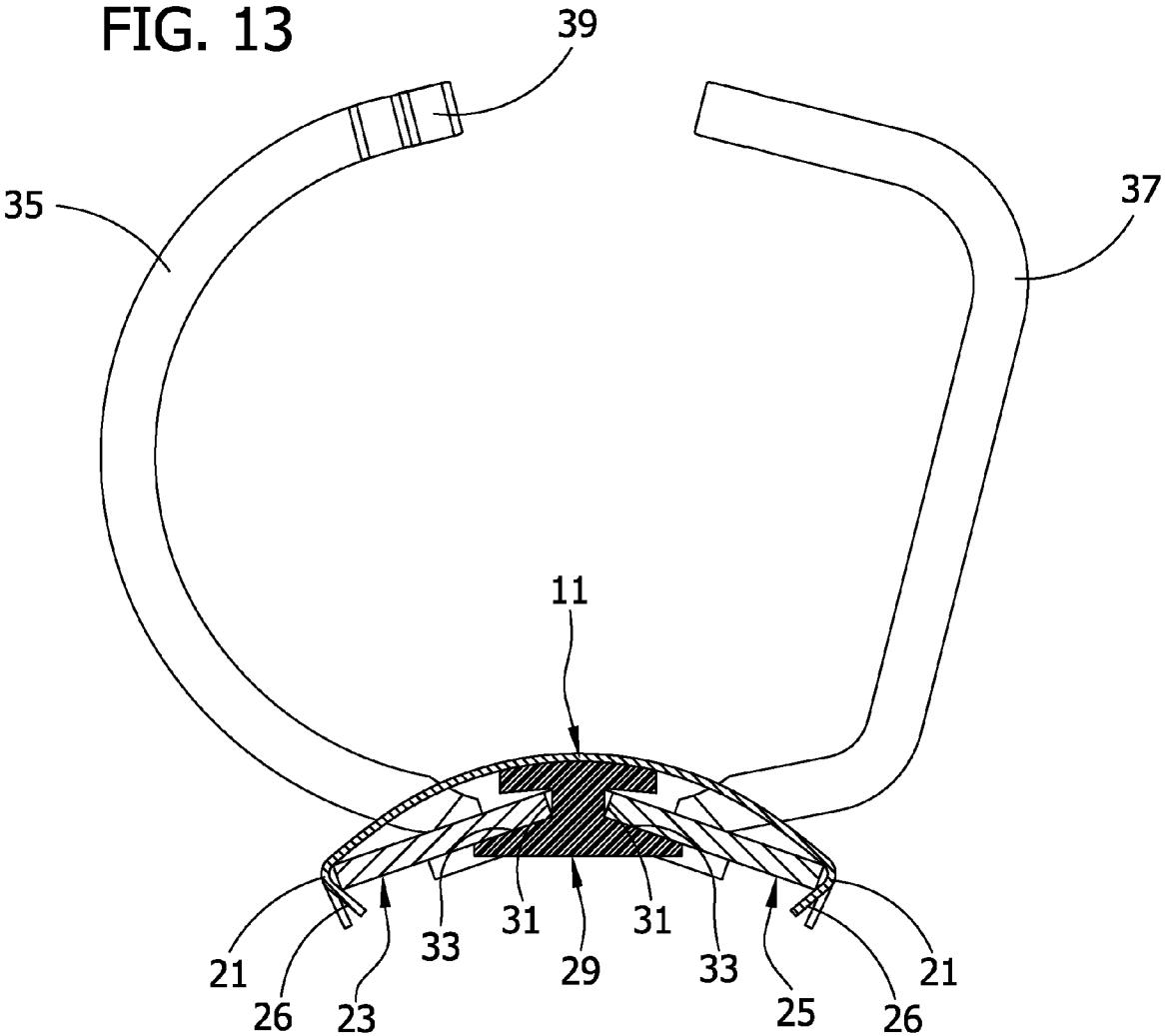
FIG. 13 is the section of FIG. 6 with the ring members in the opened position.

Operation of the ring mechanism 1 will now be described with reference to FIGS. 3-13. As shown in FIGS. 6 and 13, the hinge plates 23, 25 are supported by the housing 11 so that an angle between exterior surfaces of the hinge plates 23, 25 is always less than 180 degrees. The housing 11 is slightly narrower than the joined hinge plates 23, 25 when the hinge plates are in a coplanar position (i.e., when the angle between exterior surfaces of the hinge plates 23, 25 is 180 degrees). So as the hinge plates 23, 25 pivot toward this position, they deform the resilient housing 11 and cause a spring force in the housing that urges the hinge plates 23, 25 to pivot upward, away from the coplanar position. Specifically, the housing 11 spring force urges the hinge plates 23, 25 to pivot so that the central hinge 27 moves toward the housing 11. Thus, the ring members 35, 37 are biased by the housing 11 toward the opened position.

Figure 8:
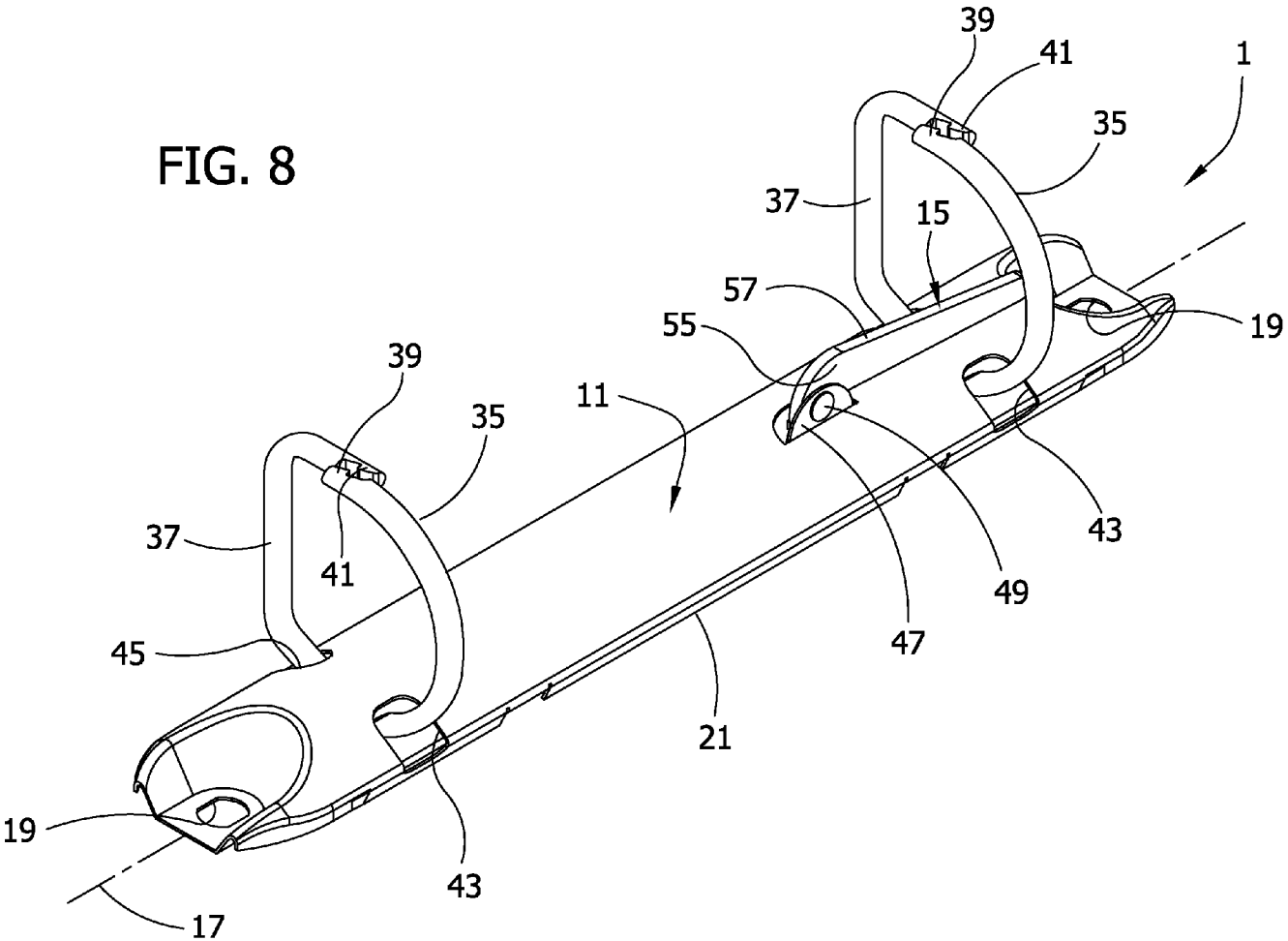
FIG. 8 is the perspective of FIG. 3 illustrating translational movement of first ring members relative to second ring members for disengaging hook-shaped ring tips thereof.
Figure 9:
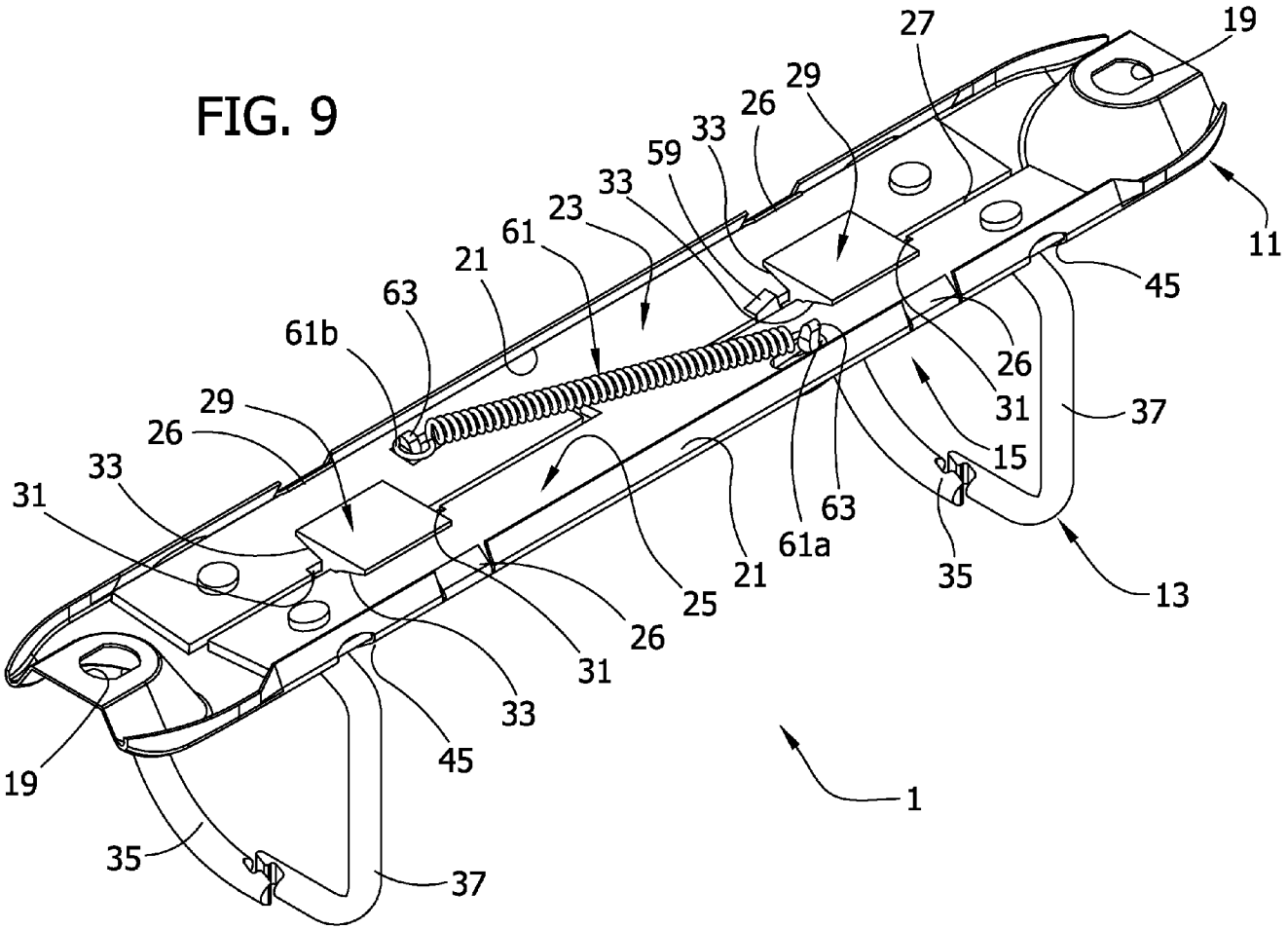
FIG. 9 is a bottom perspective of the mechanism illustrated in FIG. 8.
Figure 10:
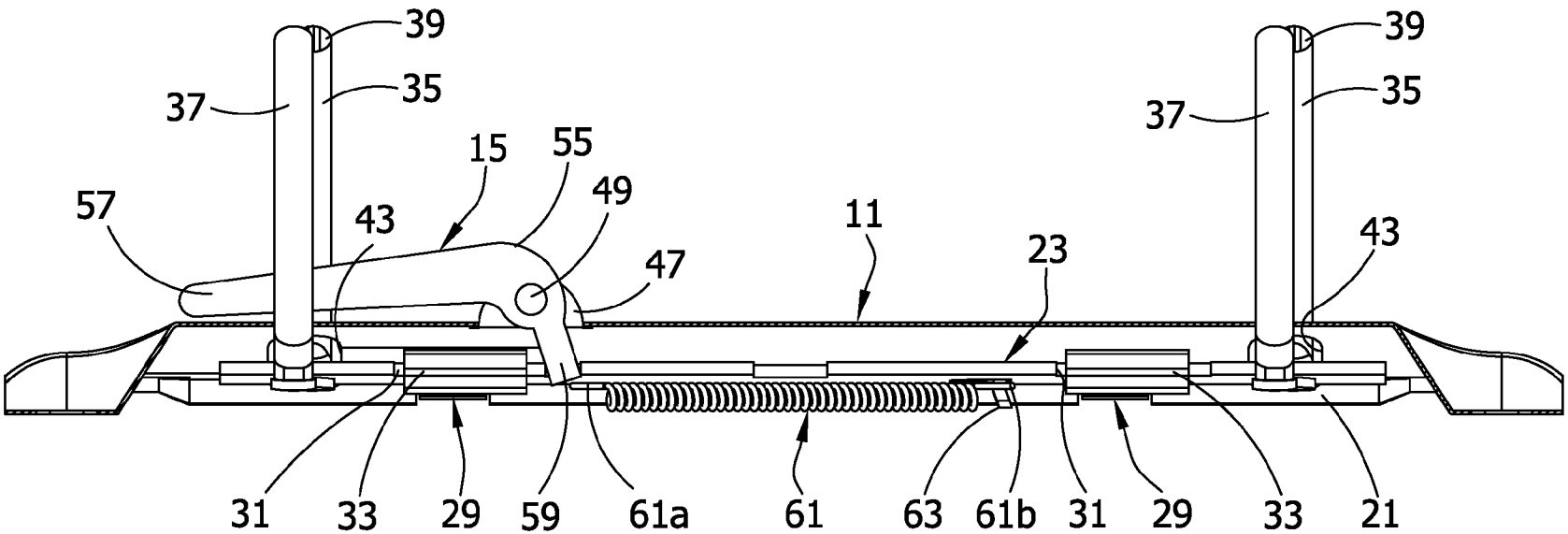
FIG. 10 is a side elevation of the mechanism of FIG. 8 with part of the housing cut away and components removed to show internal construction.

When the ring members 35, 37 are in the closed position (FIGS. 1, 3-7), they form a substantially continuous, closed, D-shaped ring or loop for retaining loose-leaf pages and for allowing the pages to move along the rings 13 from one ring member to the other. Mechanisms (not shown) with rings that form other shapes, such as circular shapes, when ring members are closed do not depart from the scope of this invention. To open the ring members 35, 37, the first arm 57 of the lever 15 is pressed downward toward the housing 11 (FIGS. 8-10). As best seen in FIG. 10, the second arm 59 moves toward an opposite end of the housing 11 and moves the first hinge plate 23 in the longitudinal direction away from the lever 15. The extension spring 61 resists this movement and extends as the hinge plate 23 moves. The first ring members 35 move longitudinally with the first hinge plate 23 and the hook-shaped formations 39, 41 of the ring members 35, 37 disengage. As soon as this occurs, the housing spring force causes the hinge plates 23, 25 to pivot upward and the ring members 35, 37 open (FIGS. 11-13). When the lever 15 is released, the spring 61 pulls the first hinge plate 23 back to the position in which the paired ring members 35, 37 are aligned, and the first hinge plate 23 pivots the lever 15 back to its opening position. The ring members 35, 37 now form a discontinuous, open loop suitable for adding or removing pages. To close the ring members 35, 37 the free ends of each pair of mating ring members are pressed together against the spring force of the housing 11 (which acts on the hinge plates 23, 25). The hook-shaped formations 39, 41 engage and securely lock the ring members 35, 37 together.

Figure 14:
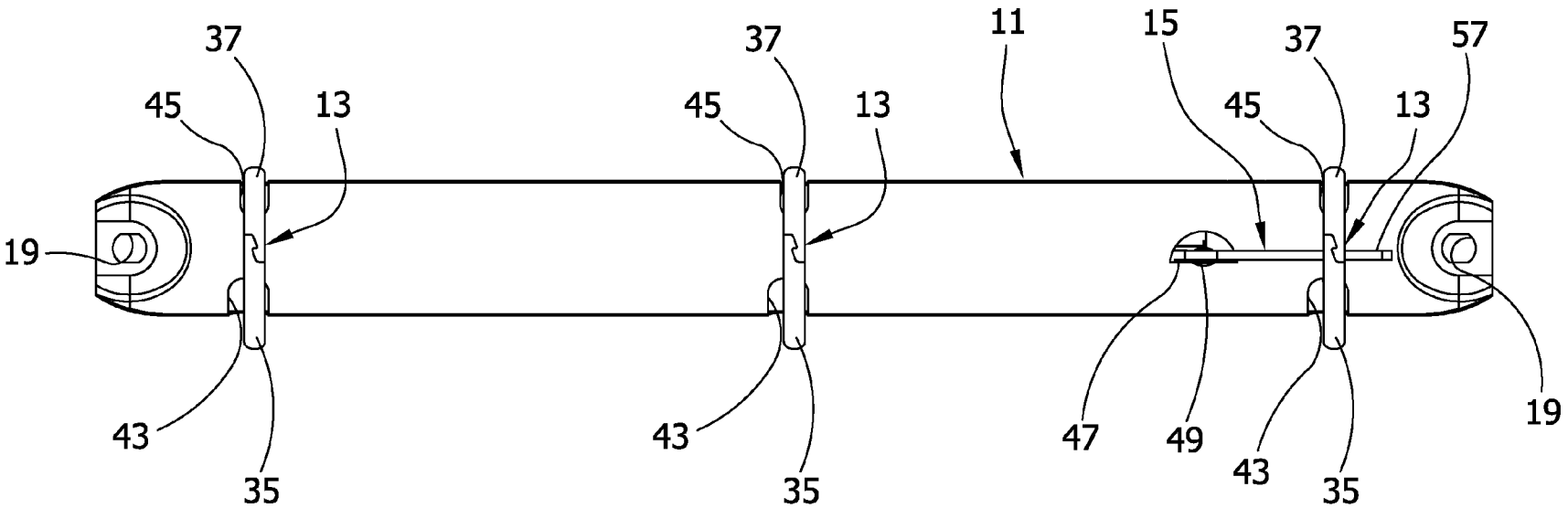
FIG. 14 is a top plan view of a variation of the ring mechanism in which the mechanism comprises three rings.
Figure 15:
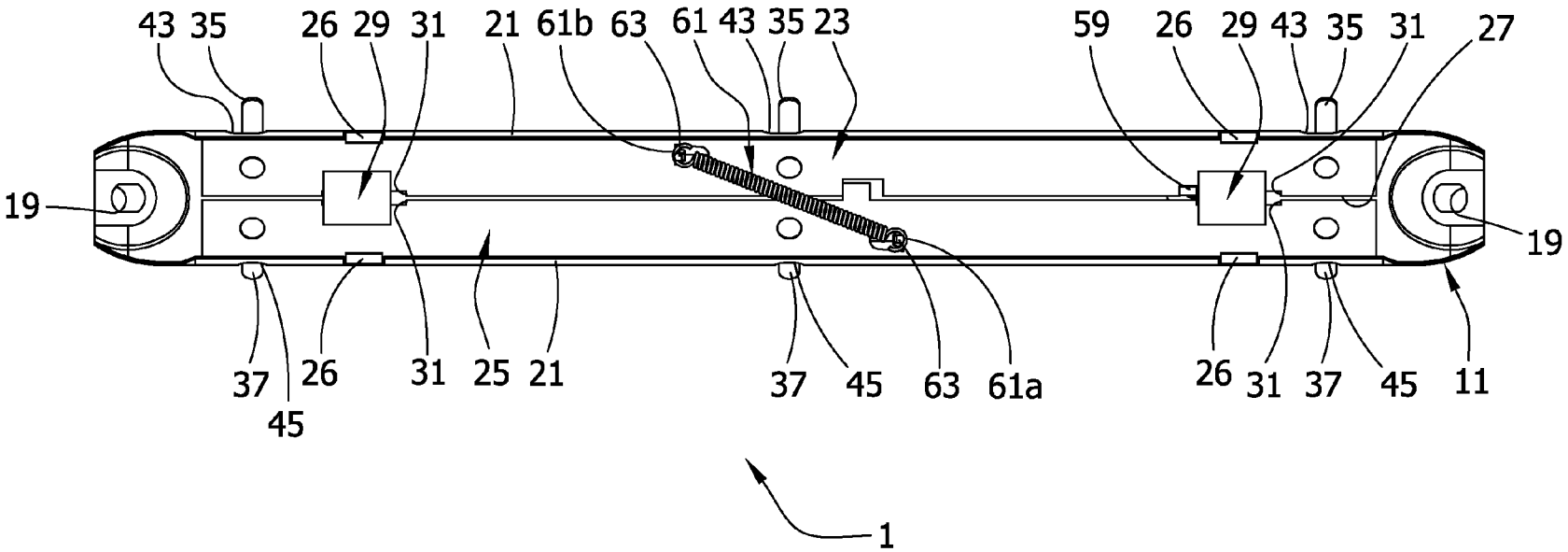
FIG. 15 is a bottom plan view thereof.

FIGS. 14 and 15 illustrate a variation of the ring mechanism 1 in which the ring mechanism comprises three rings 13. It is understood that a ring mechanism with a number of rings different from two or three as illustrated herein is within the scope of the invention (e.g., a mechanism with four rings).

Figure 16:
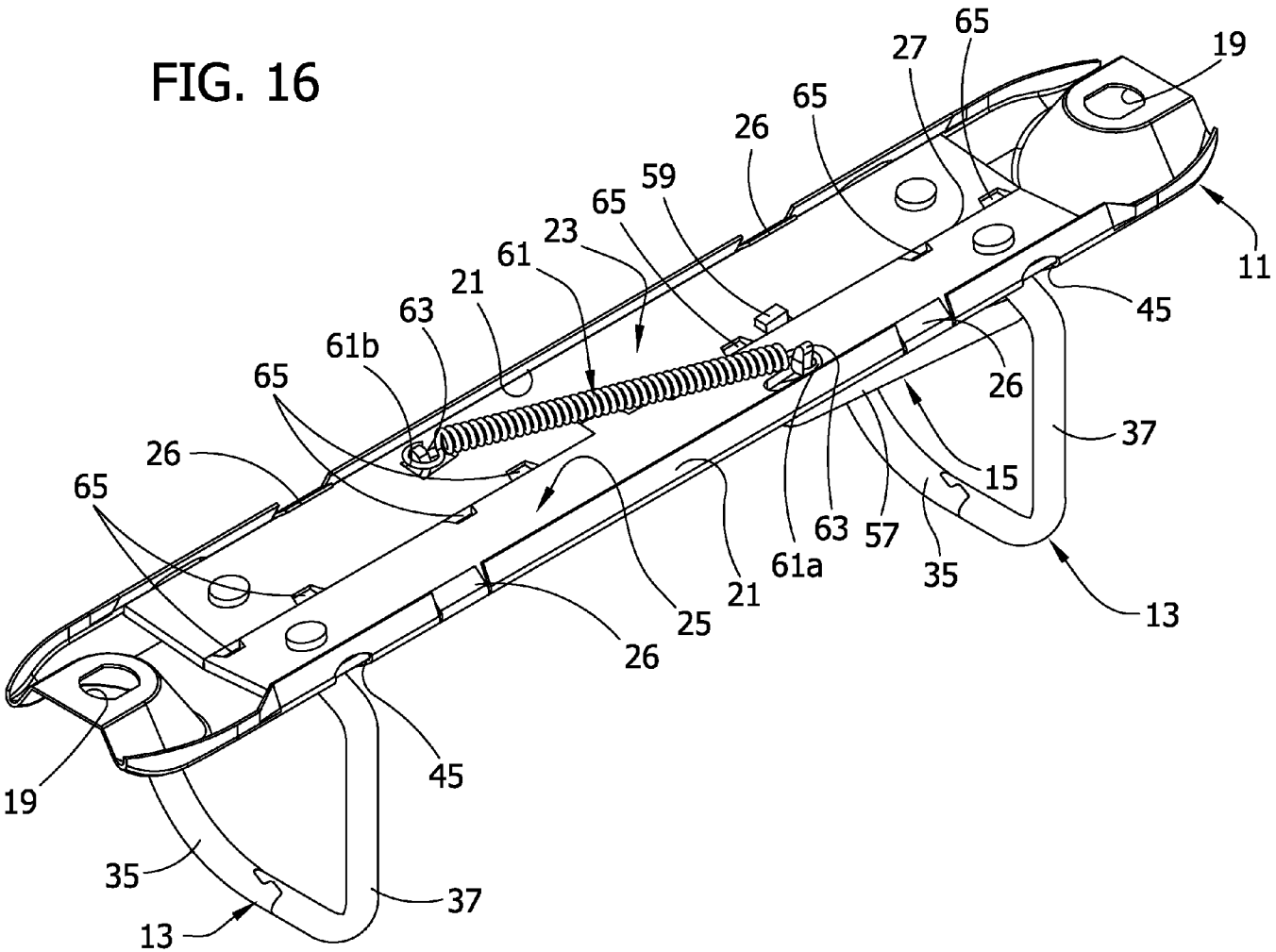
FIG. 16 is a bottom perspective of another variation of the ring mechanism in which friction buffers are removed.
Figure 17:
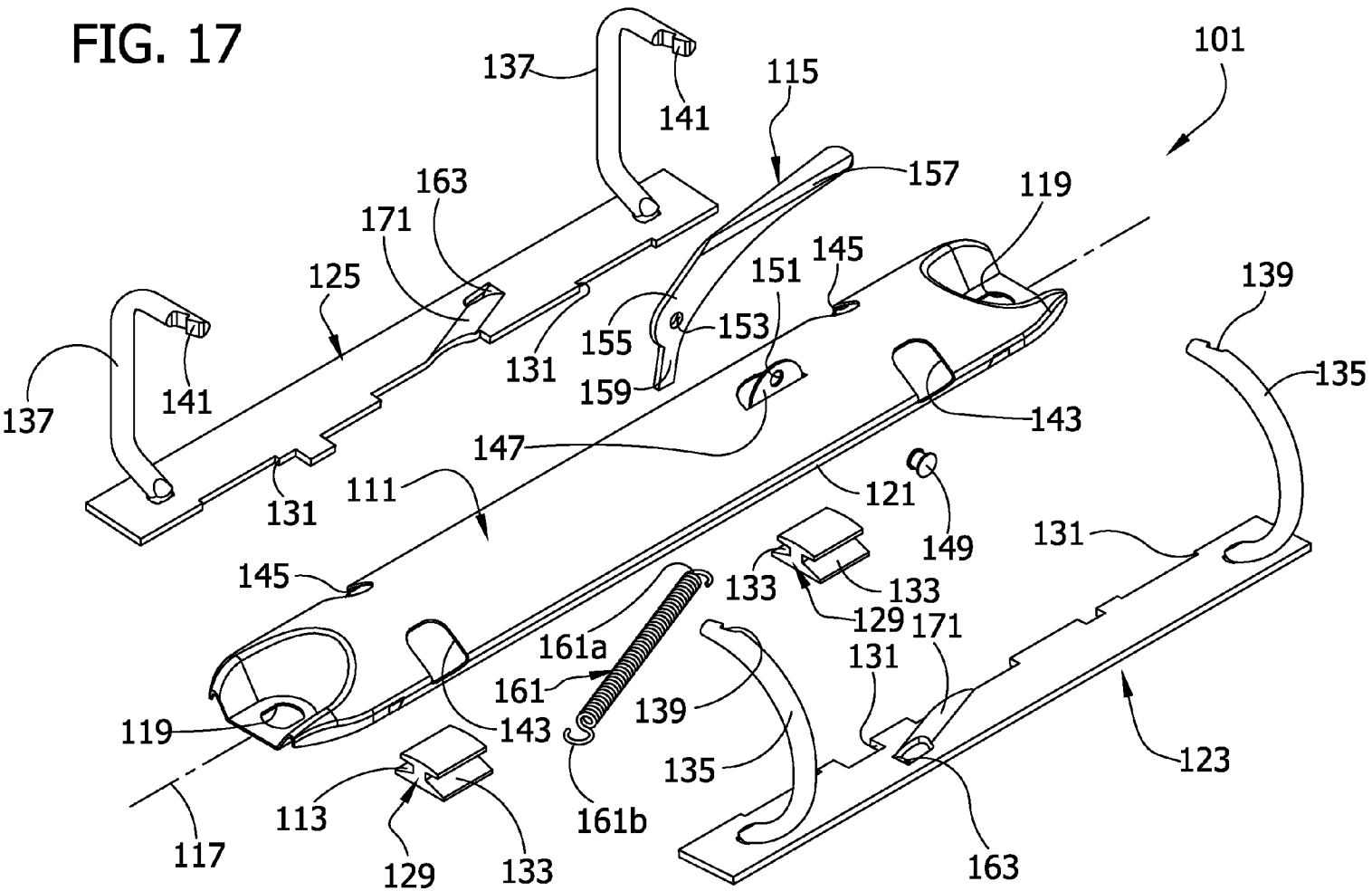
FIG. 17 is an exploded perspective of a ring binder mechanism of a second embodiment of the invention.
Figure 18:
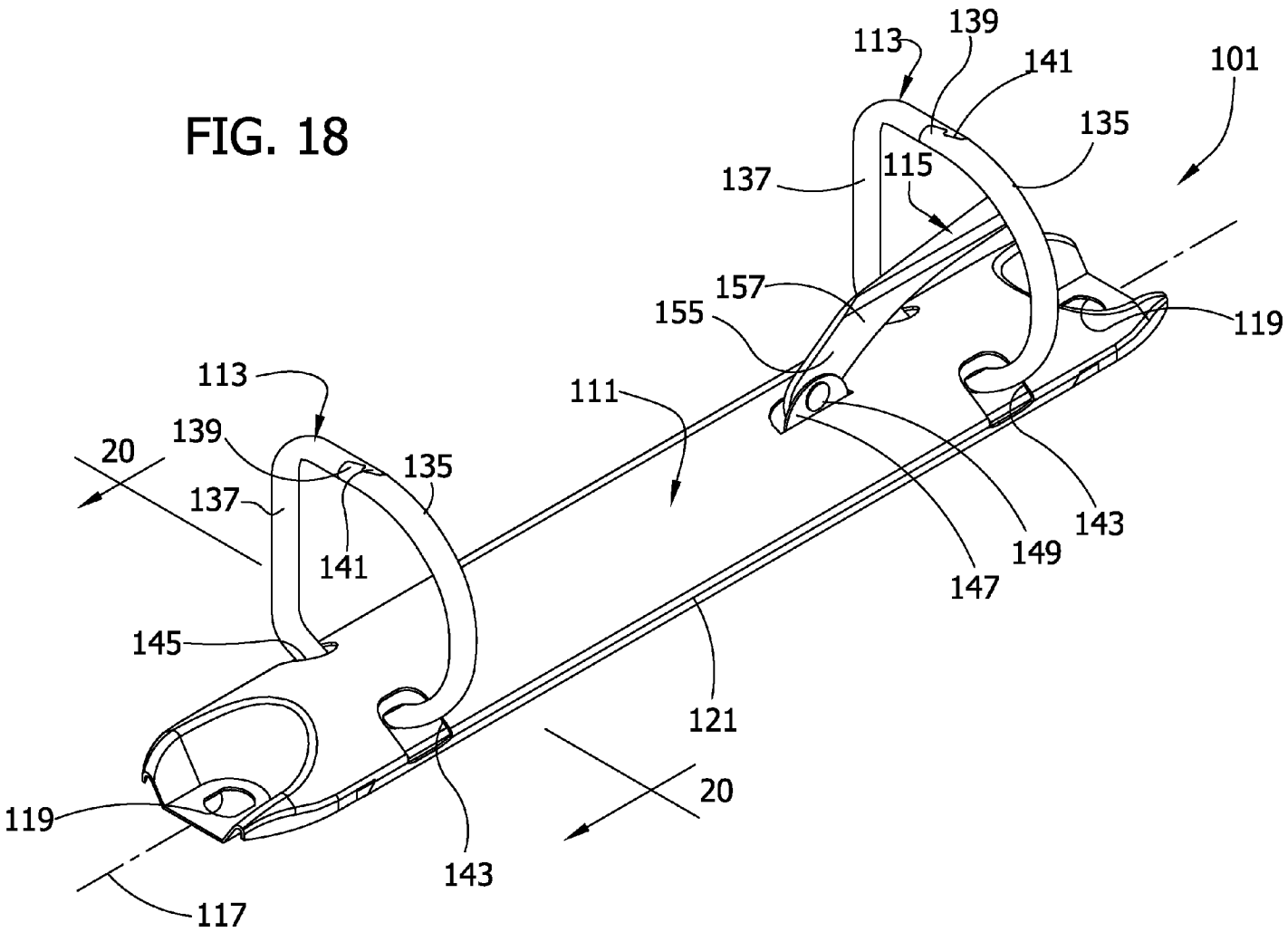
FIG. 18 is a top perspective of the ring mechanism with ring members in a closed position.
Figure 19:
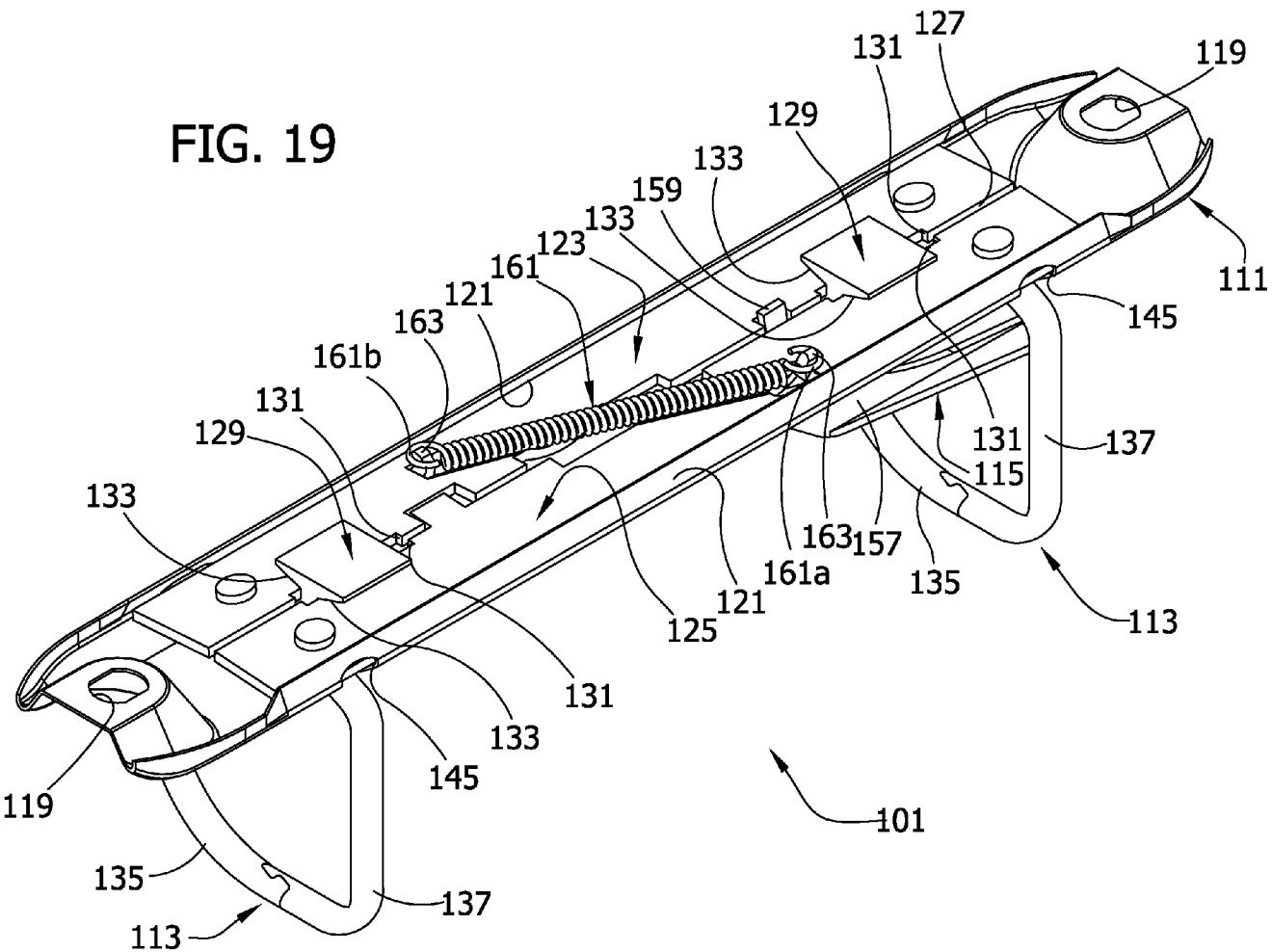
FIG. 19 is a bottom perspective thereof.
Figure 20:
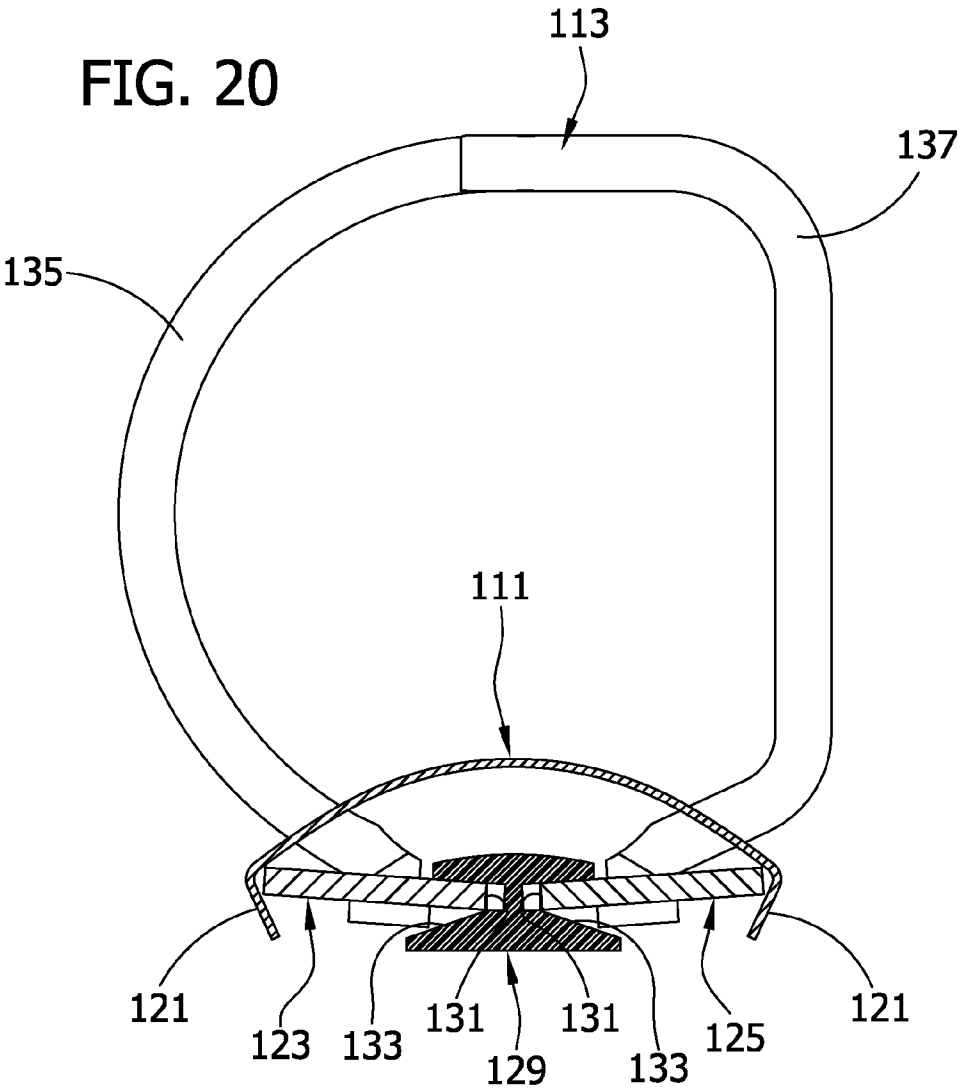
FIG. 20 is a section taken in the plane including line 20-20 of FIG. 18.
Figure 21:
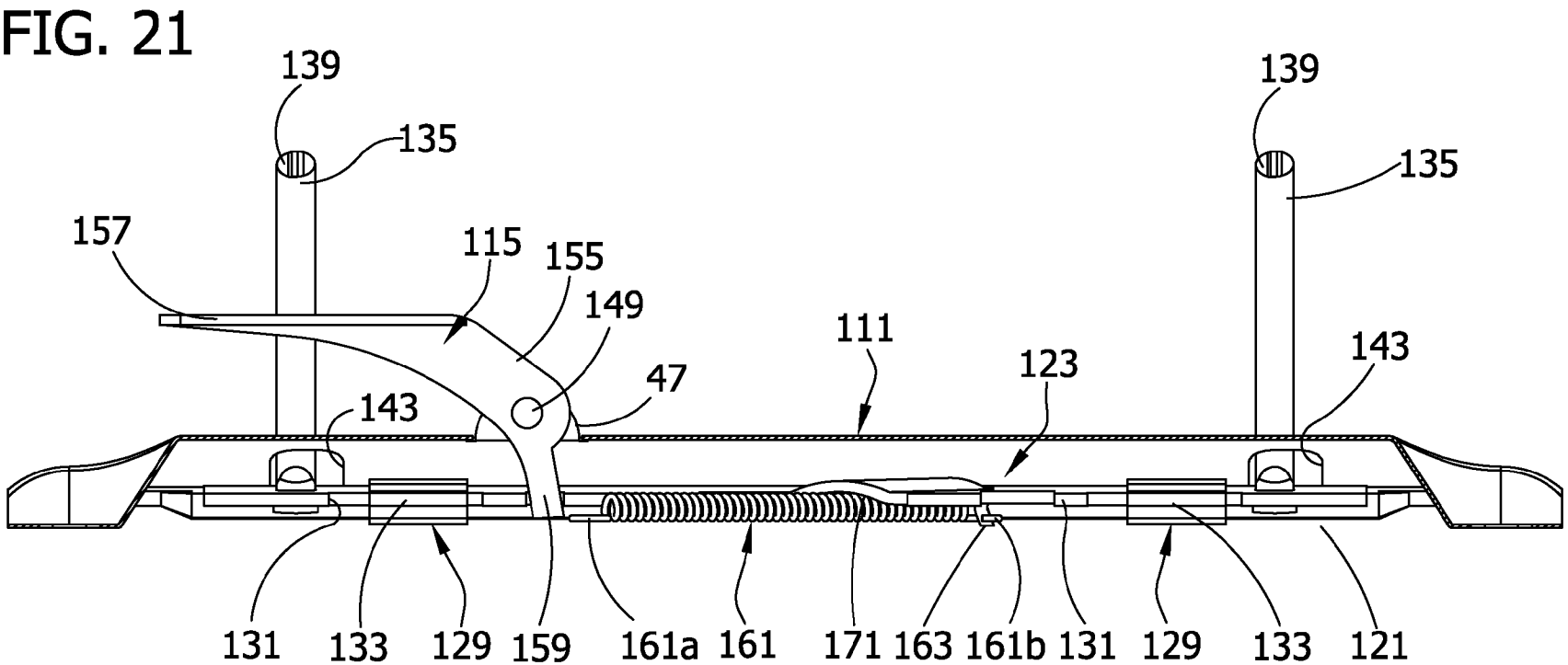
FIG. 21 is a side elevation of the ring mechanism of FIG. 18 with part of a housing cut away and components removed to show internal construction.
Figure 22:
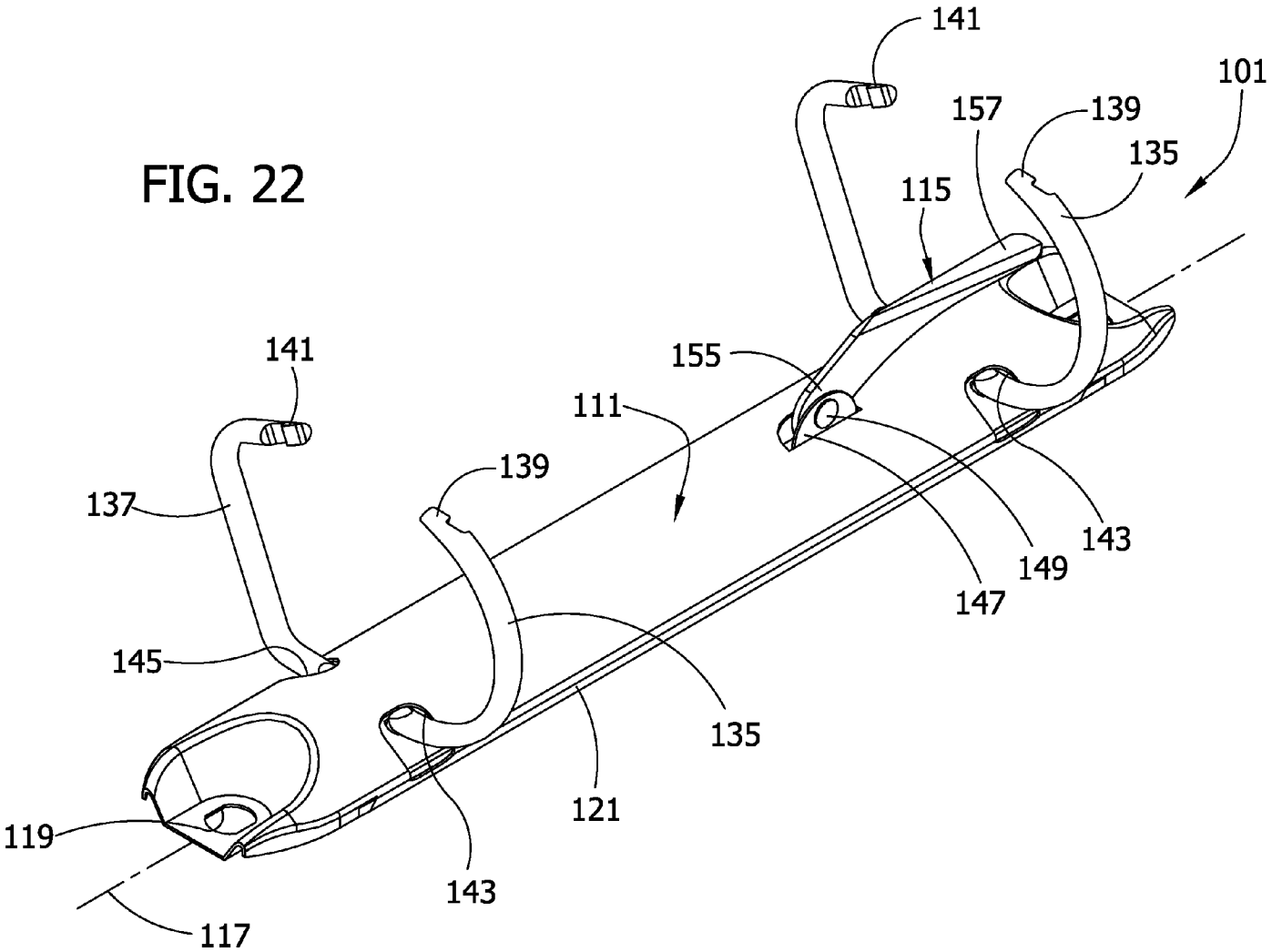
FIG. 22 is a top perspective of the ring mechanism with the ring members in an opened position.
Figure 23:
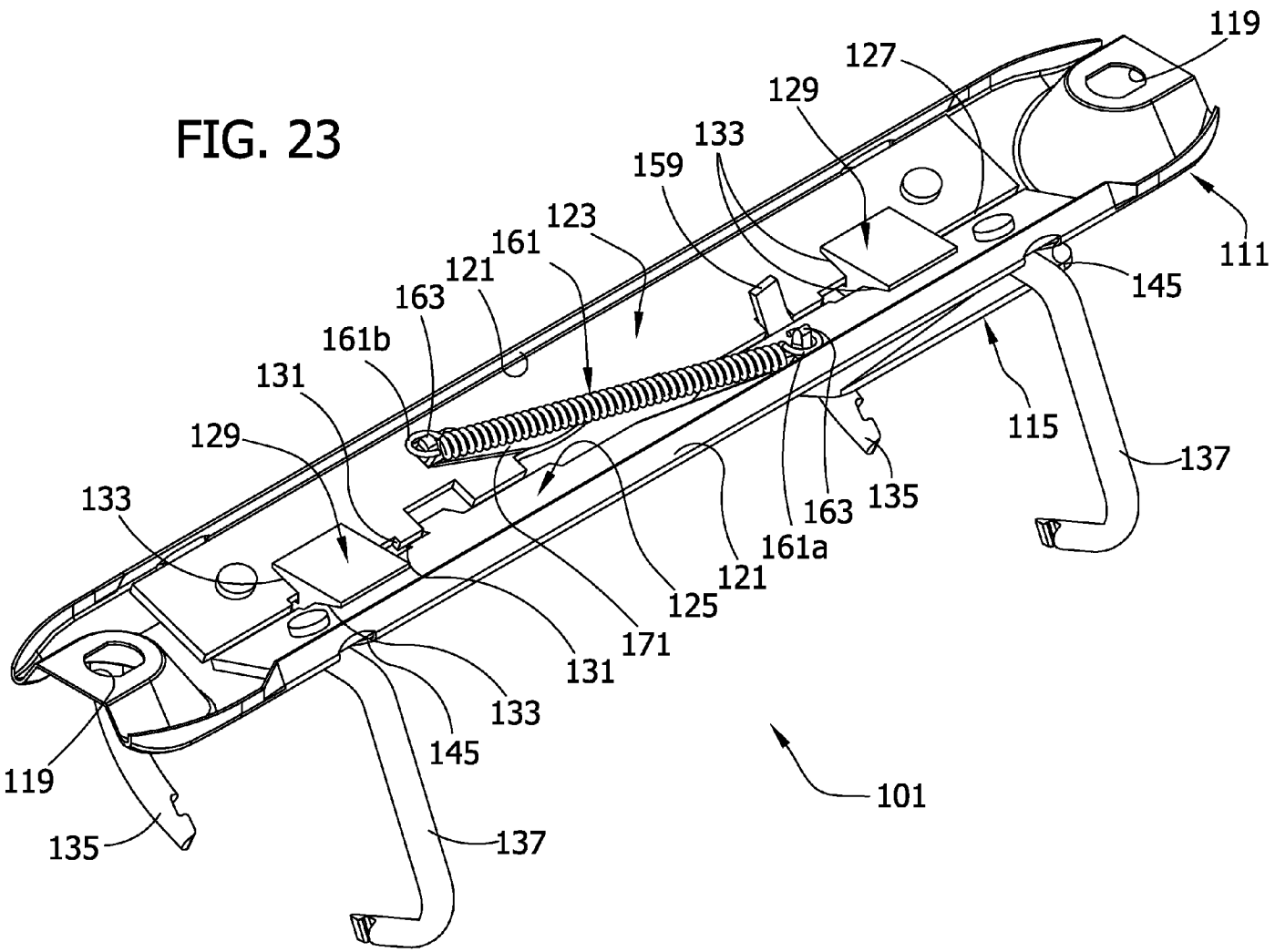
FIG. 23 is a bottom perspective thereof.
Figure 24:
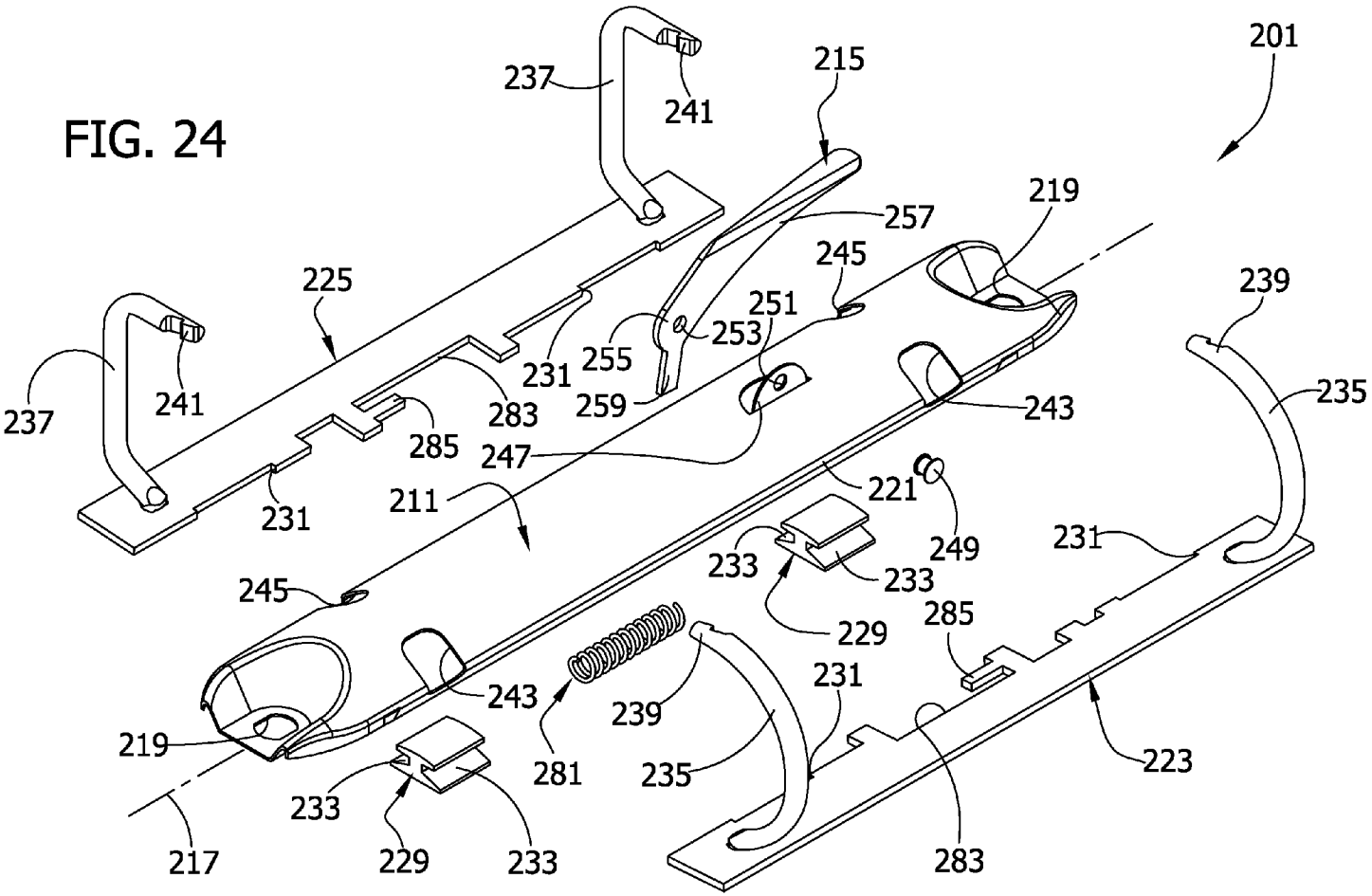
FIG. 24 is an exploded perspective of a ring binder mechanism according to a third embodiment of the invention.
Figure 25:
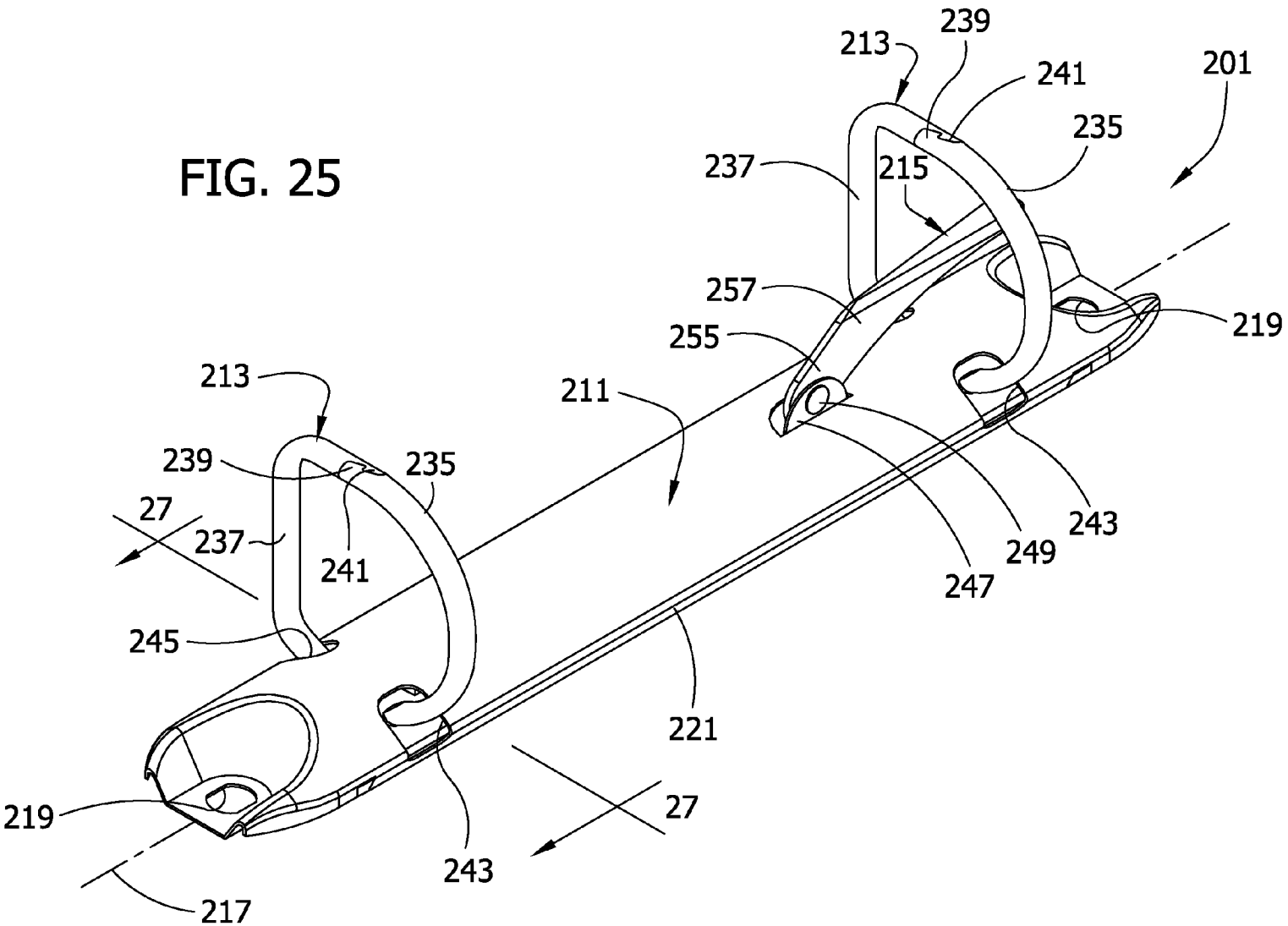
FIG. 25 is a top perspective of the mechanism with ring members in a closed position.
Figure 26:
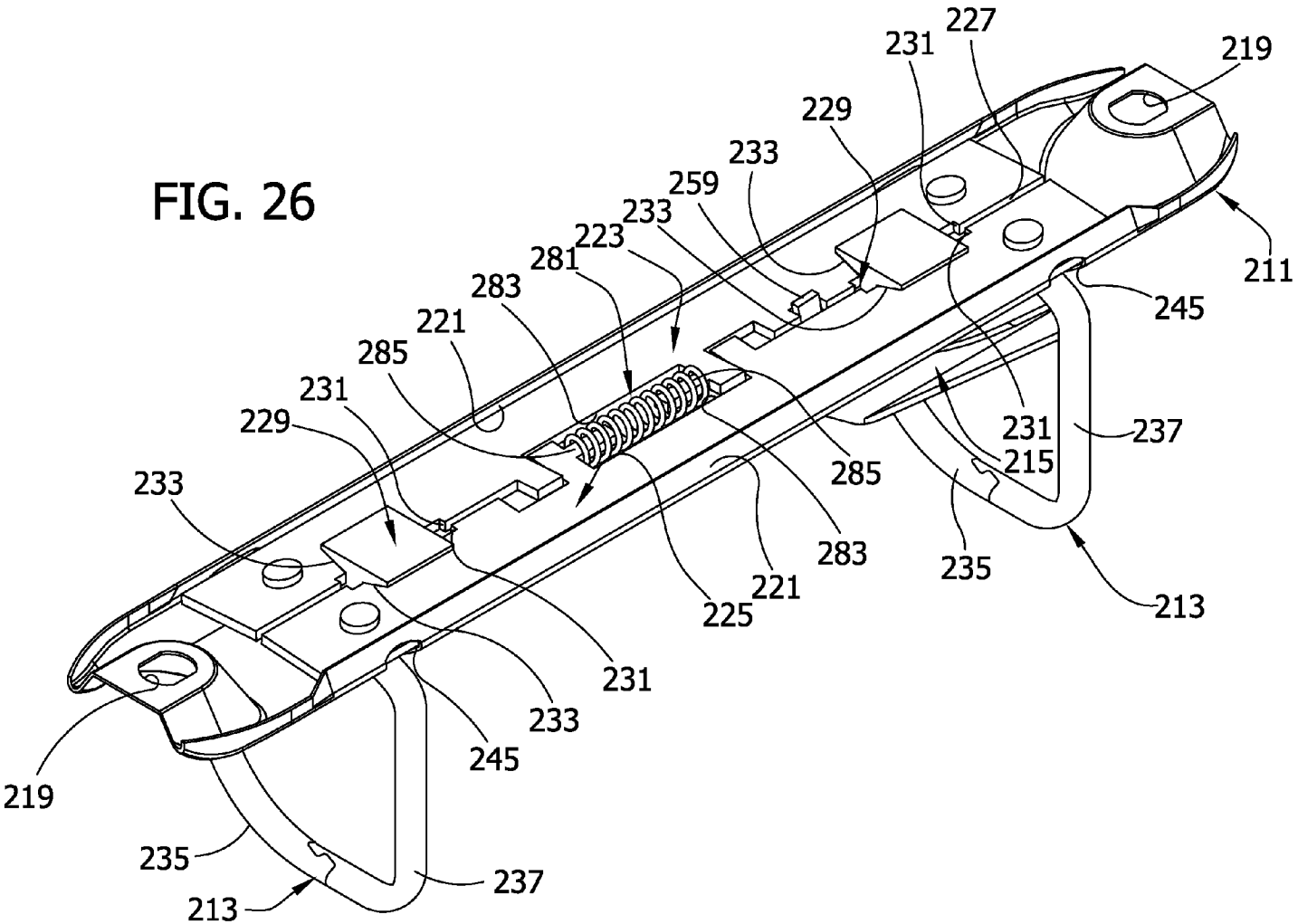
FIG. 26 is a bottom perspective thereof.
Figure 27:
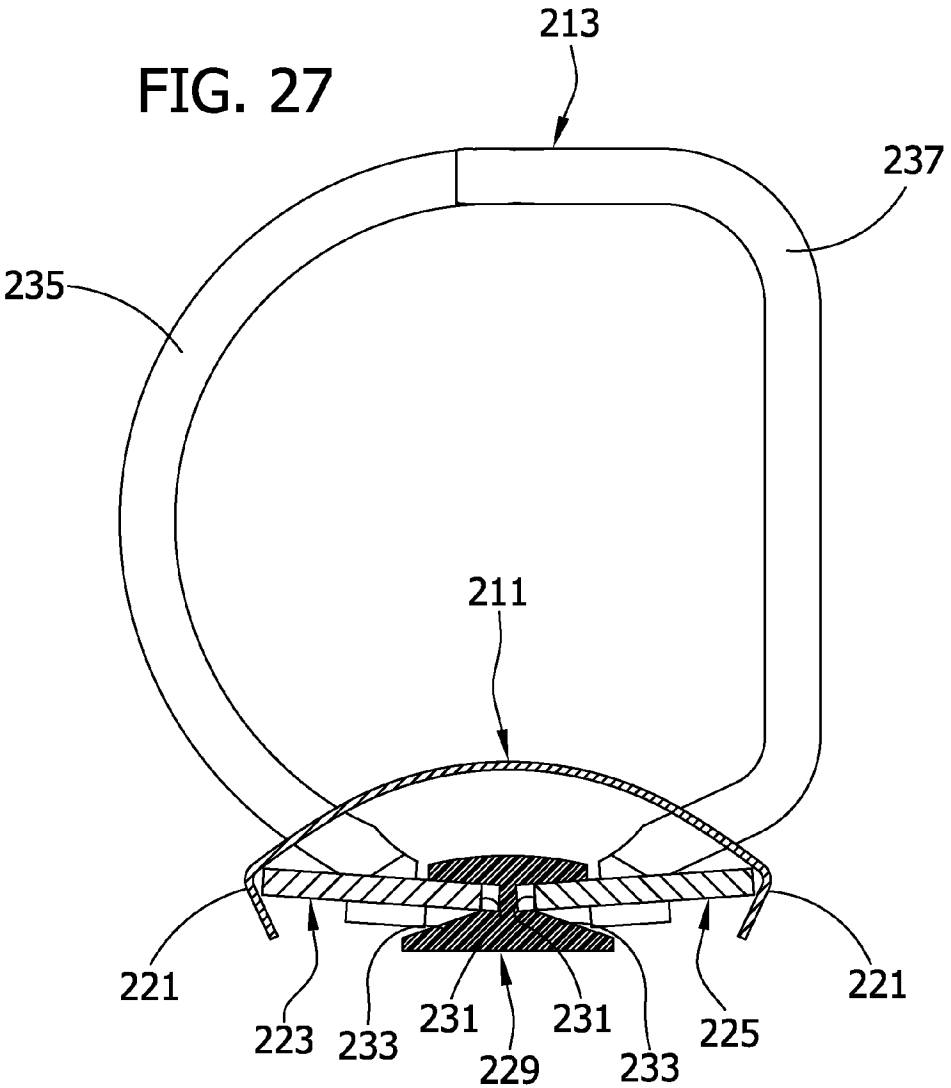
FIG. 27 is a section of the mechanism taken in a plane including line 27-27 of FIG. 25.
Figure 28:
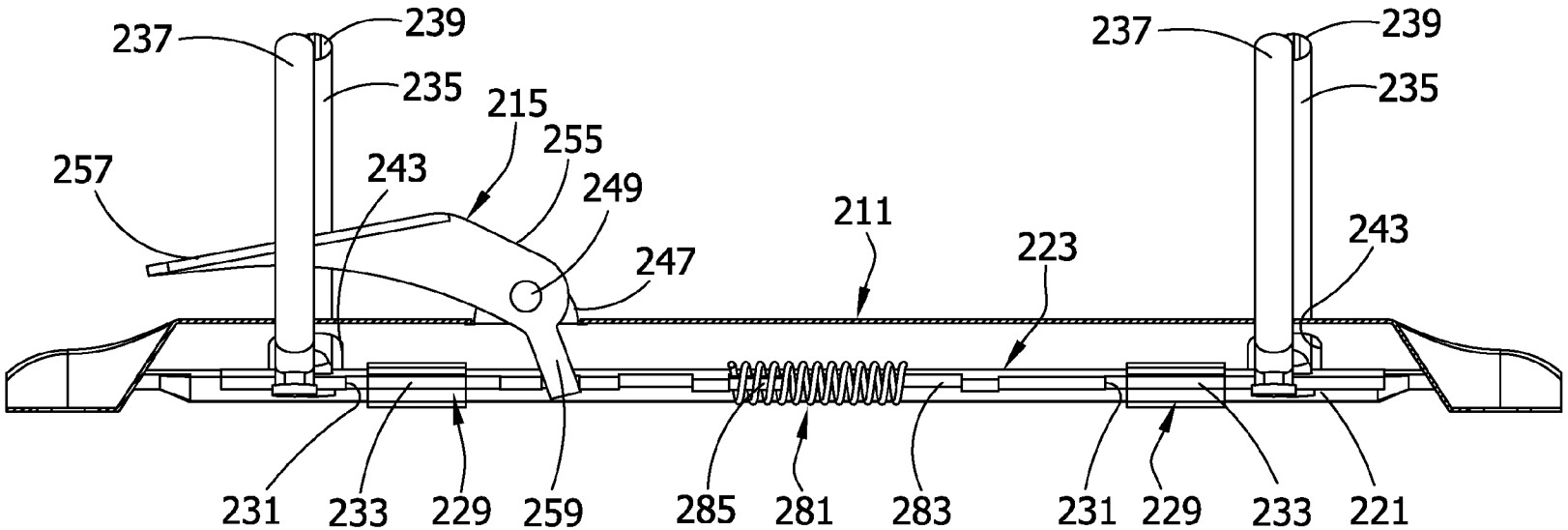
FIG. 28 is a side elevation of the ring mechanism with part of the housing cut away and a second hinge plate removed to show internal construction, and illustrating initial translational movement of the ring members for disengaging hook-shaped ring tips thereof.
Figure 29:
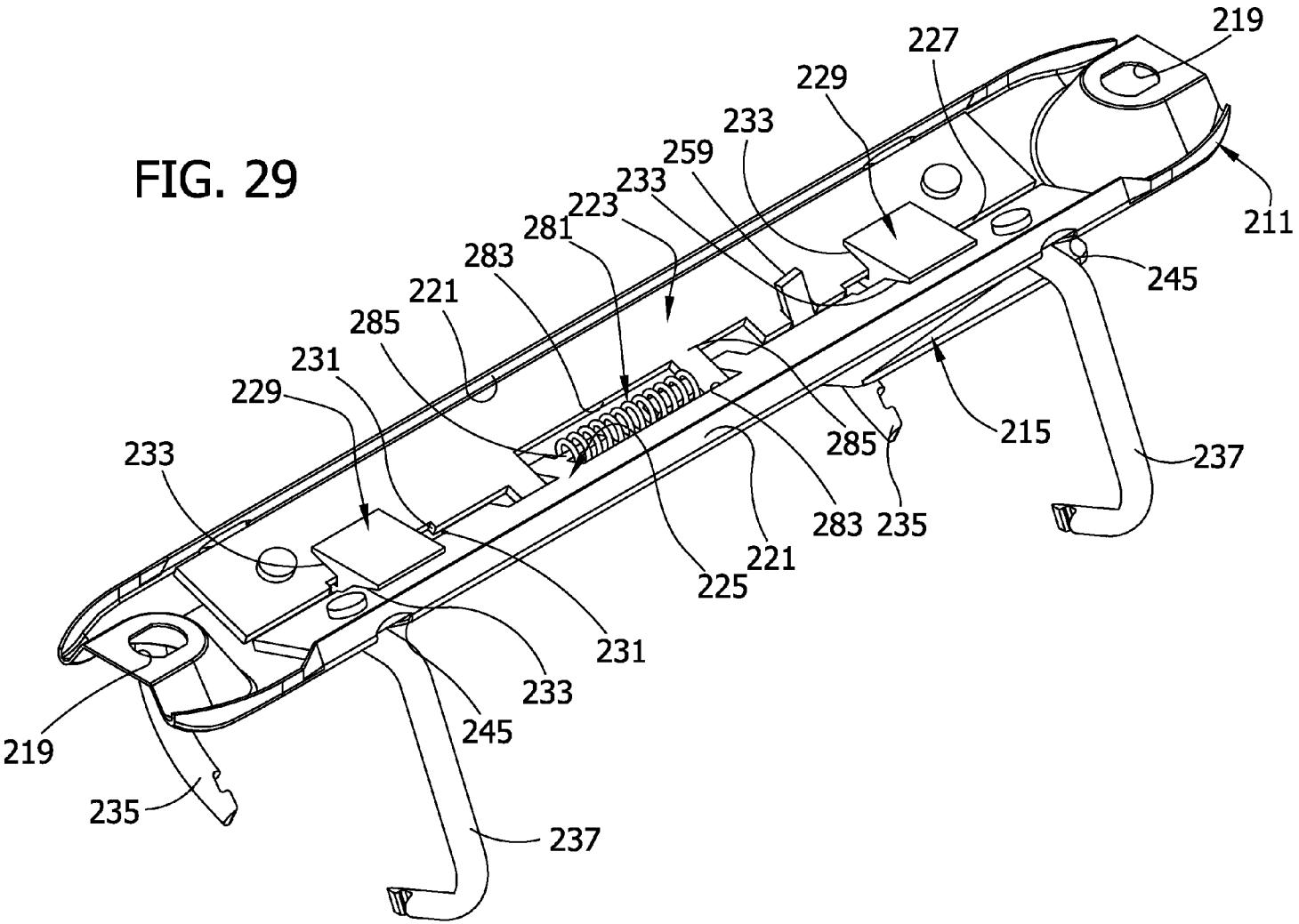
FIG. 29 is a bottom perspective of the ring mechanism with the ring members in an opened position.

FIG. 16 illustrates another variation of the ring mechanism 1. Here, friction buffers are removed and the hinge plates 23, 25 are instead formed with interconnecting tabs (each indicated at 65) that hold the hinge plates together for pivoting movement while also allowing the first hinge plate to slide in a longitudinal direction relative to the second hinge plate. The tabs 65 of the first hinge plate 23 extend a short distance over the upper surface of the second hinge plate 25, and the tabs 65 of the second hinge plate 25 extend a short distance over the upper surface of the first hinge plate 23. This holds the inner edges of the hinge plates 23, 25 in alignment as the plates pivot or slide.

FIGS. 17-23 illustrate a second embodiment of the invention substantially similar to the ring mechanism 1 of the first embodiment. The ring mechanism of this embodiment is indicated generally at 101, and parts of this mechanism corresponding to parts of the mechanism 1 of the first embodiment (FIGS. 1-13) are indicated by the same reference numbers, plus "100". The ring mechanism 101 differs from that of the first embodiment in that hinge plates 123, 125 pivot through a co-planar position when ring members 135, 137 open and close. So as the hinge plates 123, 125 pass through the co-planar position, a housing spring force urges the hinge plates to pivot away from the coplanar position, either downward (away from a housing 111) for closing the ring members 135, 137 or upward (toward the housing 111) for opening the ring members. When the ring members 135, 137 are closed, the housing spring force resists pivoting movement of the hinge plates 123, 125 upward and holds the ring members from opening (even after the first hinge plate 123 slides longitudinally to disengage hook-shaped formations 139, 141 of the ring members 135, 137). Therefore, in this embodiment to open the ring members 135, 137 a lever 115 first slides the first hinge plate 123 longitudinally for disengaging the ring members 135, 137 and then pushes upward on the first hinge plate, moving the interconnected hinge plates 123, 125 through the co-planar position for opening the ring members. More specifically, a second arm 159 of the lever 115 extends a distance below the hinge plates 123, 125 (see FIGS. 19 and 21) and pivots the hinge plates upward through the co-planar position against the spring force of the housing 111 for opening the ring members 135, 137 after sliding the first hinge plate 123 longitudinally.

Also in this embodiment, a channel 171 is formed in the hinge plates 123, 125 for receiving an extension spring 161. Part of the channel 171 extends across a first hinge plate 123 and part extends across a second hinge plate 125 so that the channel 171 seats the extension spring 161 in position across both hinge plates 123, 125. The channel 171 opens downwardly, away from the housing 111, to receive the extension spring 161 that is disposed on the undersides of the hinge plates 123, 125. As described for the first embodiment, the spring 161 connects to detents 163 formed in the hinge plates 123, 125 and urges the first hinge plate 123 to a position in which first and second ring members 135, 137 of each ring 113 are aligned. The channel 171 recesses the spring 161 partially within, or above, outer surfaces of the hinge plates 123, 125 so that the spring does not provide substantial urge to the hinge plates to pivot them upward through the co-planar position when the ring members 135, 137 disengage. However, it is envisioned that a spring could be arranged under hinge plates to pivot the hinge plates upward through the co-planar position for opening ring members when the ring members disengage; a lever would not need to pivot the hinge plates upward for opening the ring members.

FIGS. 24-29 illustrate a third embodiment of the invention. The ring mechanism of this embodiment is indicated generally at 201, and is similar to the ring mechanism 1 of the first embodiment. Parts of this mechanism corresponding to parts of the mechanism 1 of the first embodiment are indicated by the same reference numbers, plus "200". In this embodiment, the hinge plates 223, 225 pivot through the co-planar position as was described for the second embodiment so that a lever 215 pivots the hinge plates 223, 225 upward for opening ring members 235, 237. Also in this embodiment, a compression spring 281 is located in cutouts 283 along a central hinge 227 of the hinge plates 223, 225. Longitudinal tabs 285 formed on the hinge plates 223, 225 extend into the cutouts 283 and receive ends of spring 281 to hold the spring in position between the hinge plates. When a first hinge plate 223 moves relative to a second hinge plate 225 to disengage hook-shaped formations 239, 241, the spring 281 compresses and urges the hinge plate 223 to move back to the position in which a first ring member 235 and a second ring member 237 are aligned. Operation of the mechanism 201 is the same as operation of the mechanism 1 of the first embodiment in all other respects.

Figure 30:
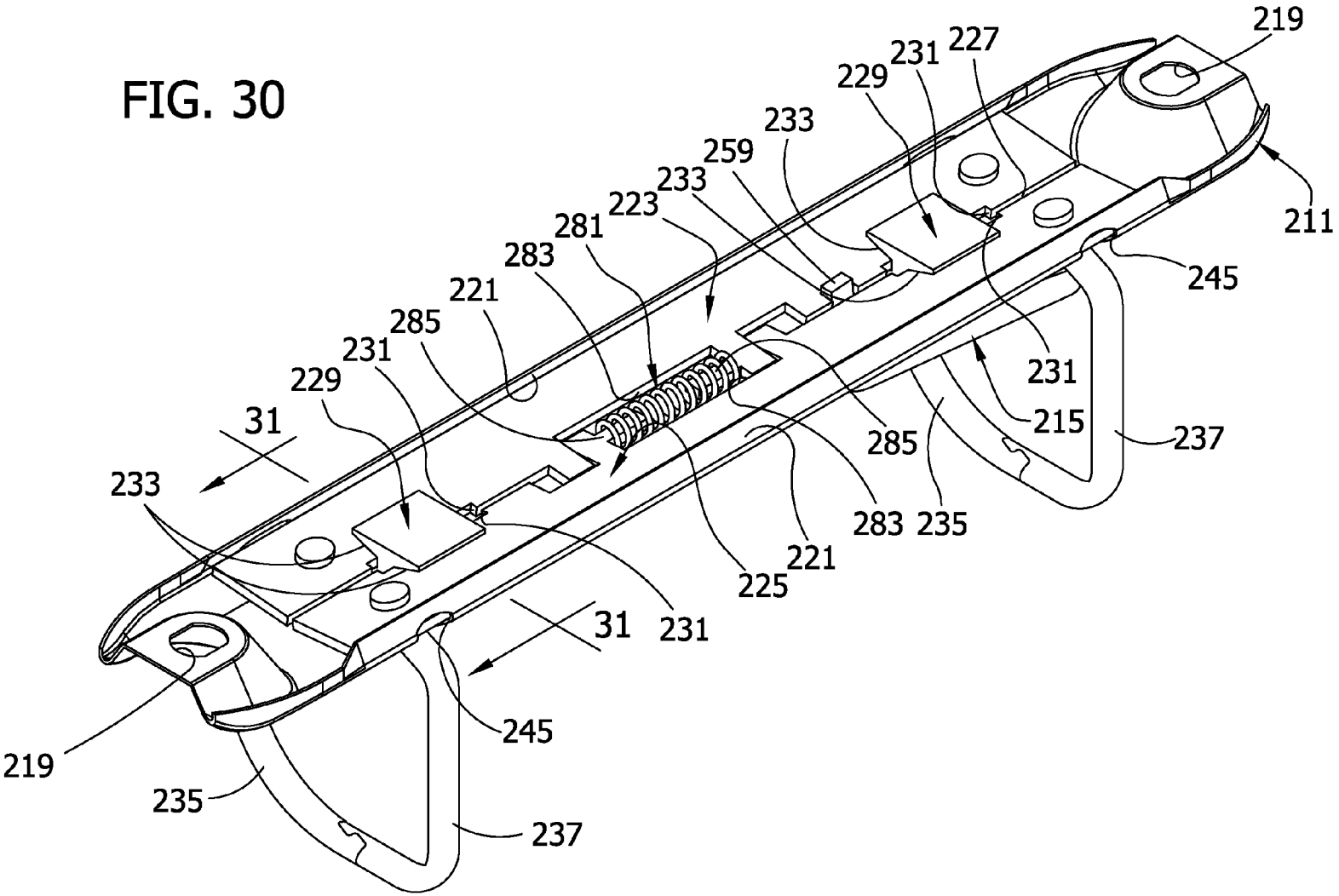
FIG. 30 is a bottom perspective of a variation of the ring mechanism of this embodiment in which the hinge plates do not pass through a co-planar position during operation.
Figure 31:
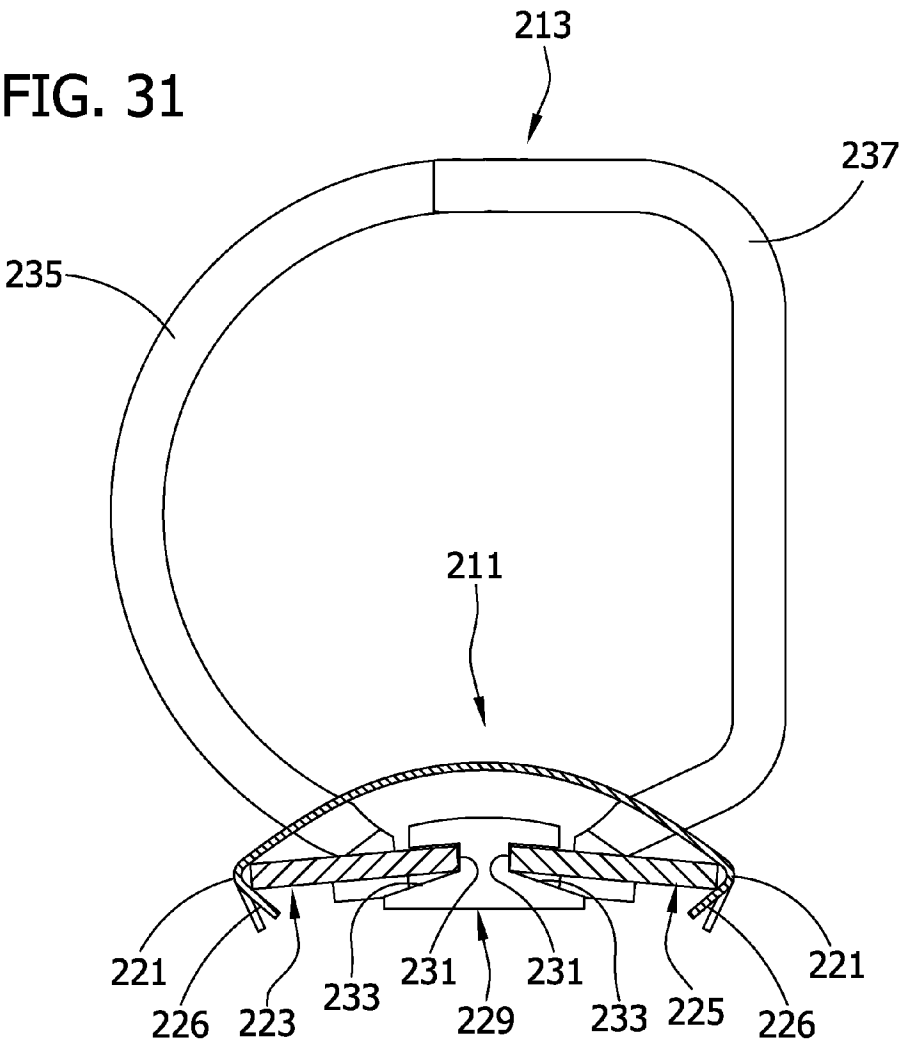
FIG. 31 is a section taken in a plane including line 31-31 of FIG. 30.

FIGS. 30 and 31 illustrate a variation of the ring mechanism 201 of the third embodiment in which the hinge plates 223, 225 are supported by a housing 211 so that the hinge plates do not pass through a co-planar position when opening and closing the ring members 235, 237. Thus when the first hinge plate 223 slides to release the interconnection of the ring members 235, 237, the ring members automatically swing open. This is similar to the orientation of the hinge plates 23, 25 described for the first embodiment and will not be described further.

Figure 32:
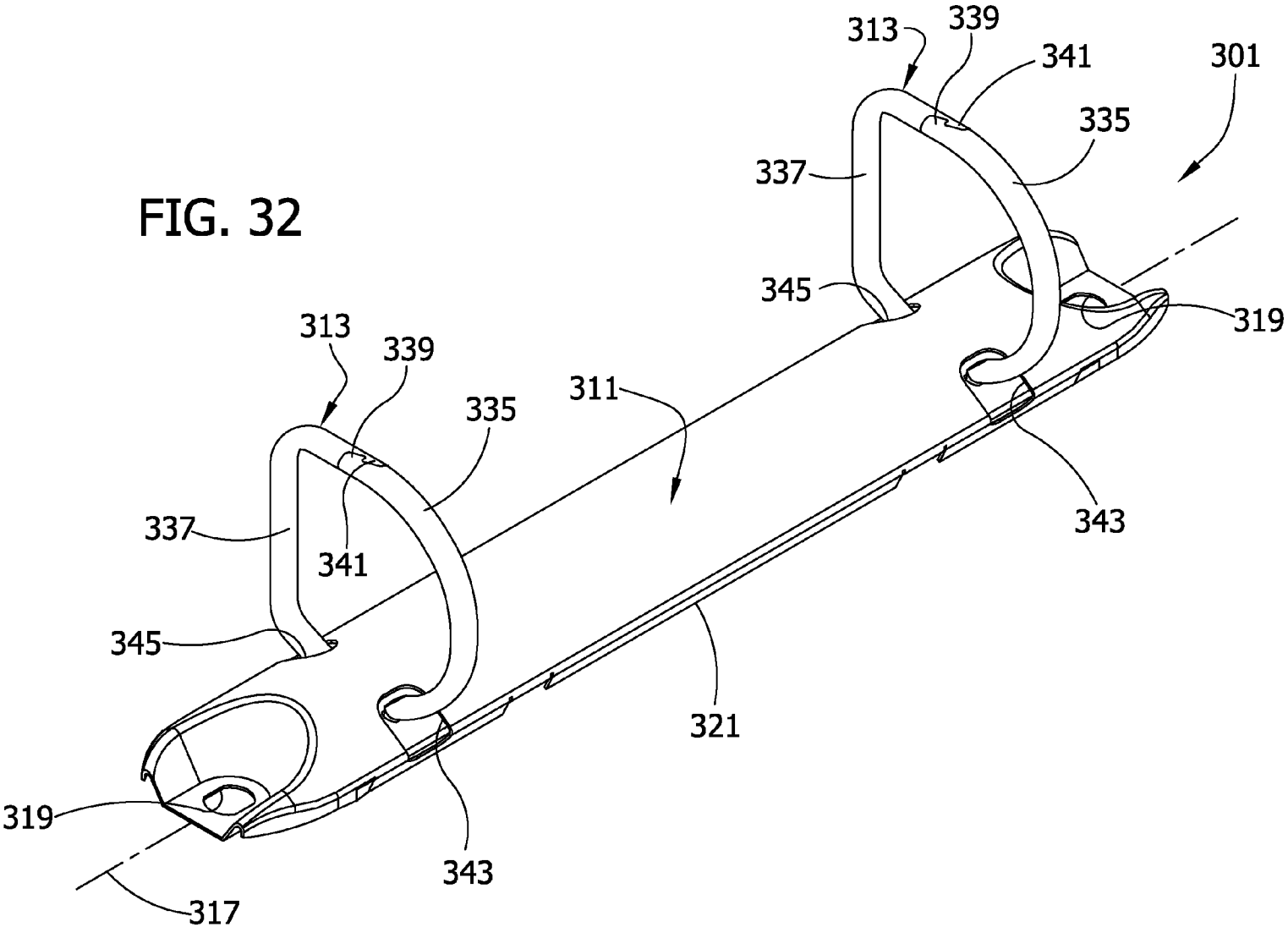
FIG. 32 is a top perspective of a ring binder mechanism of a fourth embodiment of the invention.
Figure 33:
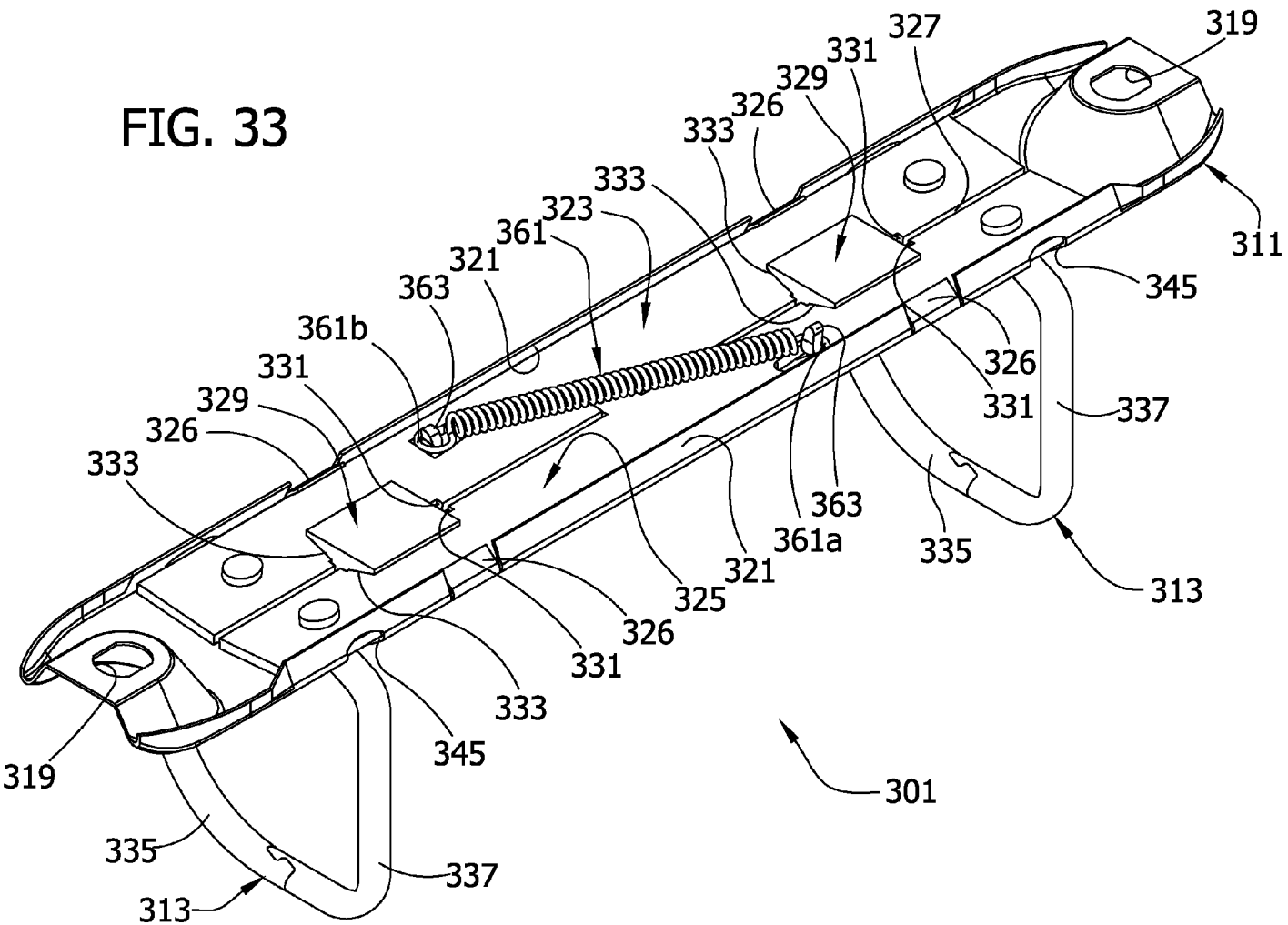
FIG. 33 is a bottom perspective thereof.
Figure 34:
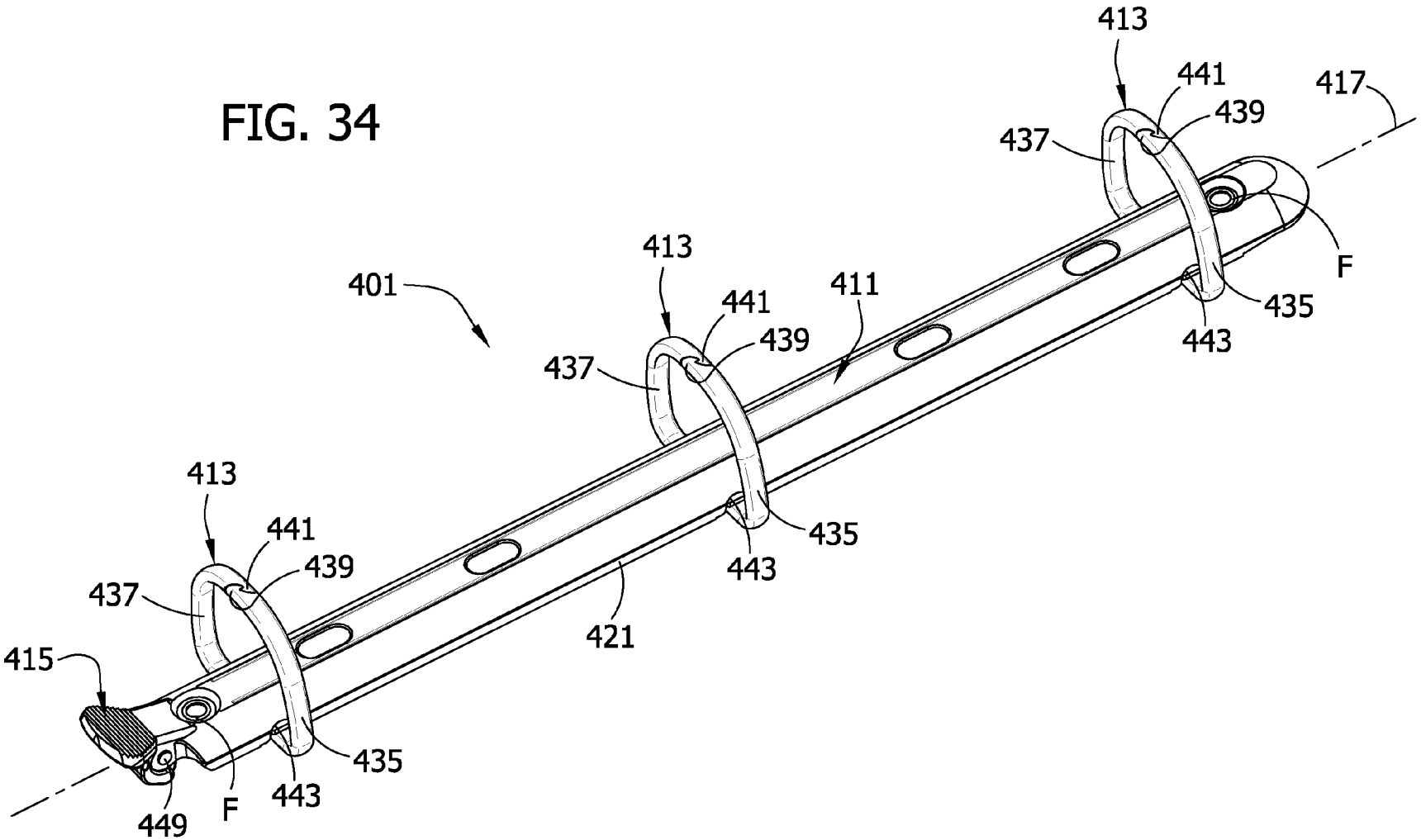
FIG. 34 is a top perspective of a ring binder mechanism of a fifth embodiment of the invention with ring members of the mechanism in a closed position.
Figure 35:
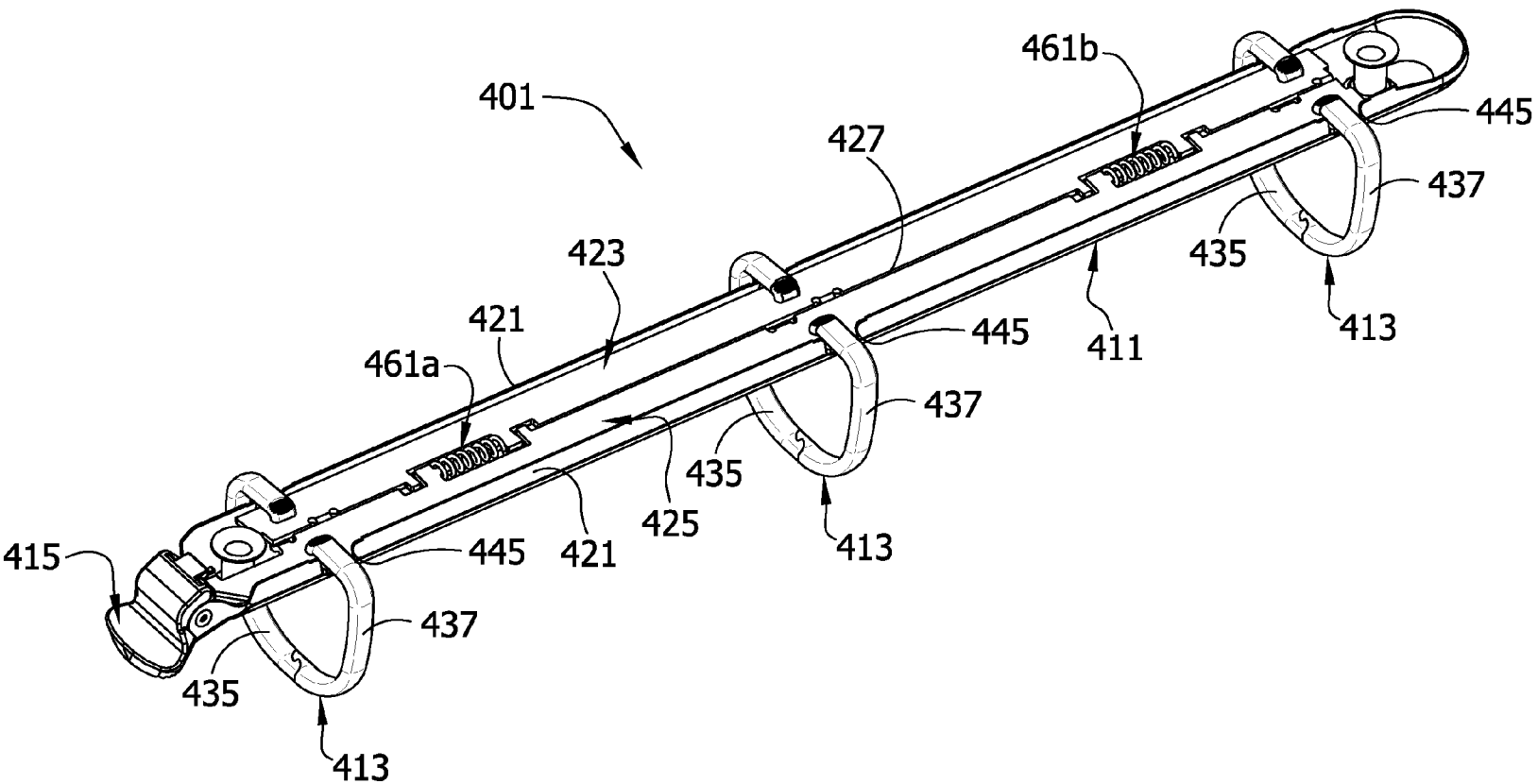
FIG. 35 is a bottom perspective thereof.
Figure 36:
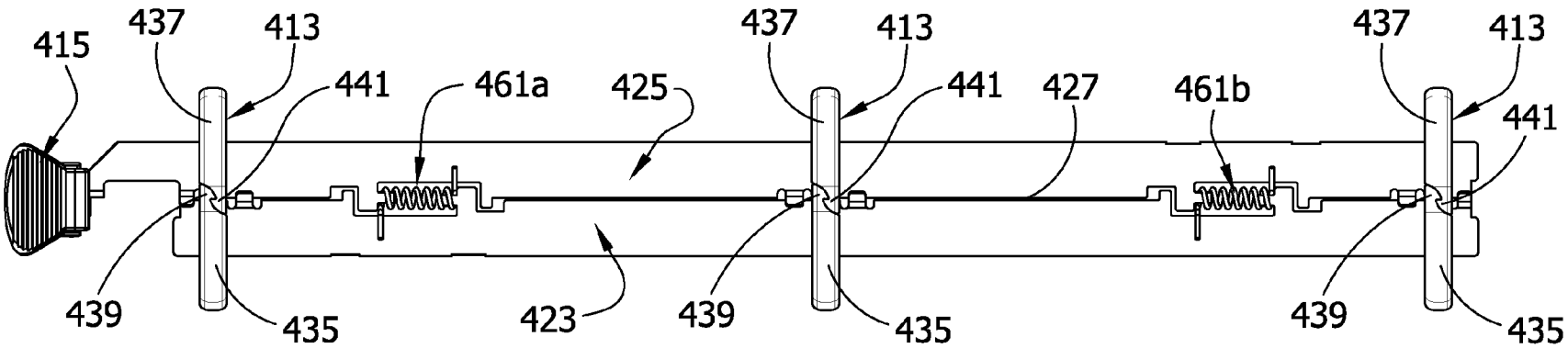
FIG. 36 is a top plan view of the ring binder mechanism with a housing thereof removed to show the relative position of hinge plates.
Figure 37:
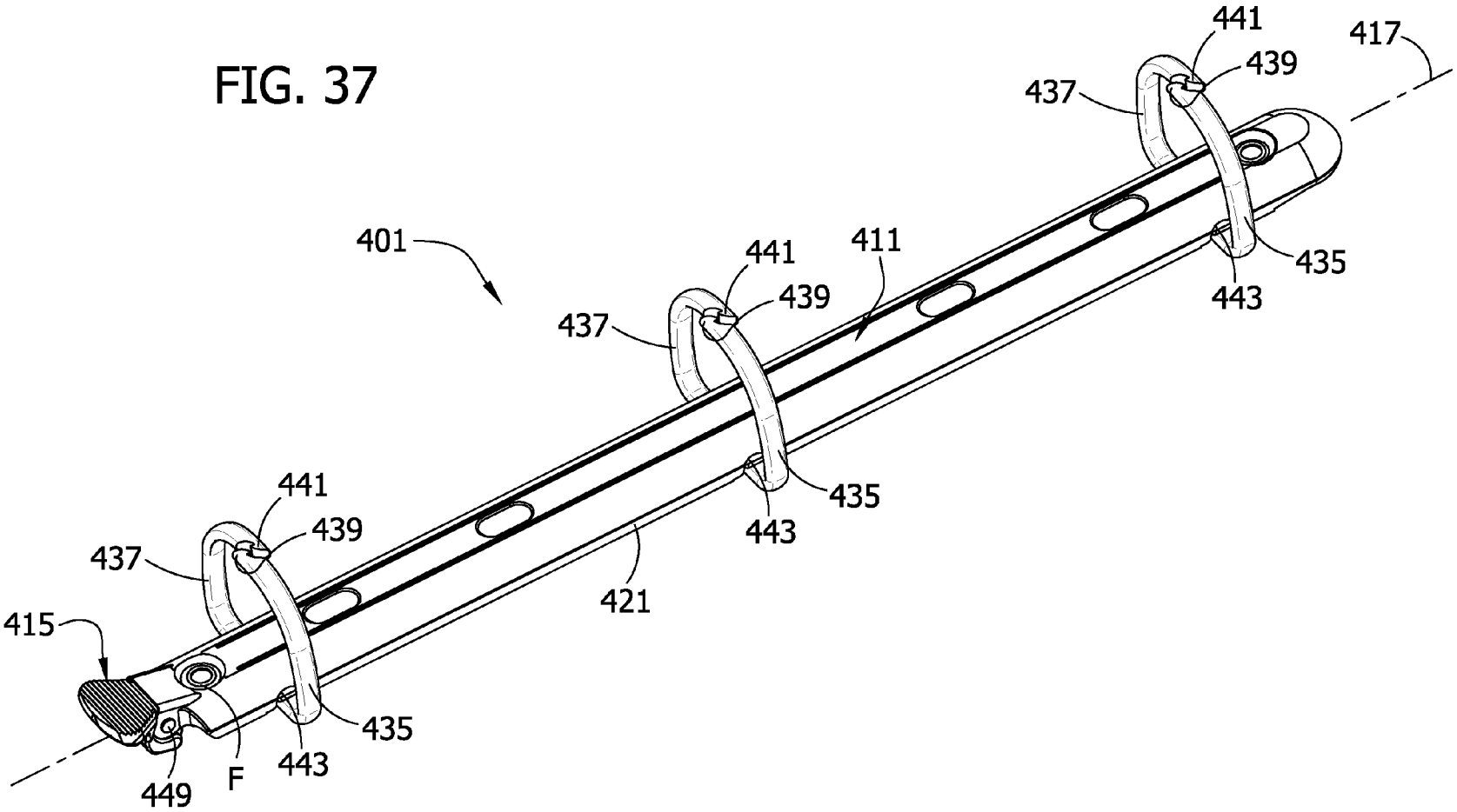
FIG. 37 is a top perspective similar to FIG. 34 but showing translational movement of first ring members relative to second ring members for disengaging hook-shaped ring tips thereof.
Figure 38:
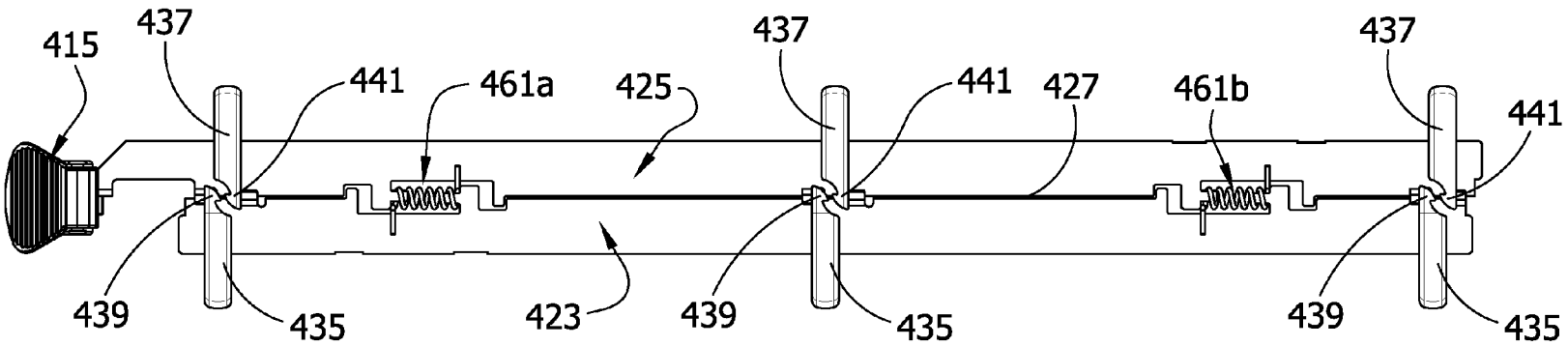
FIG. 38 is a top plan view similar to FIG. 36 but showing translational movement of the hinge plates as well as the translational movement of the ring members.
Figure 39:
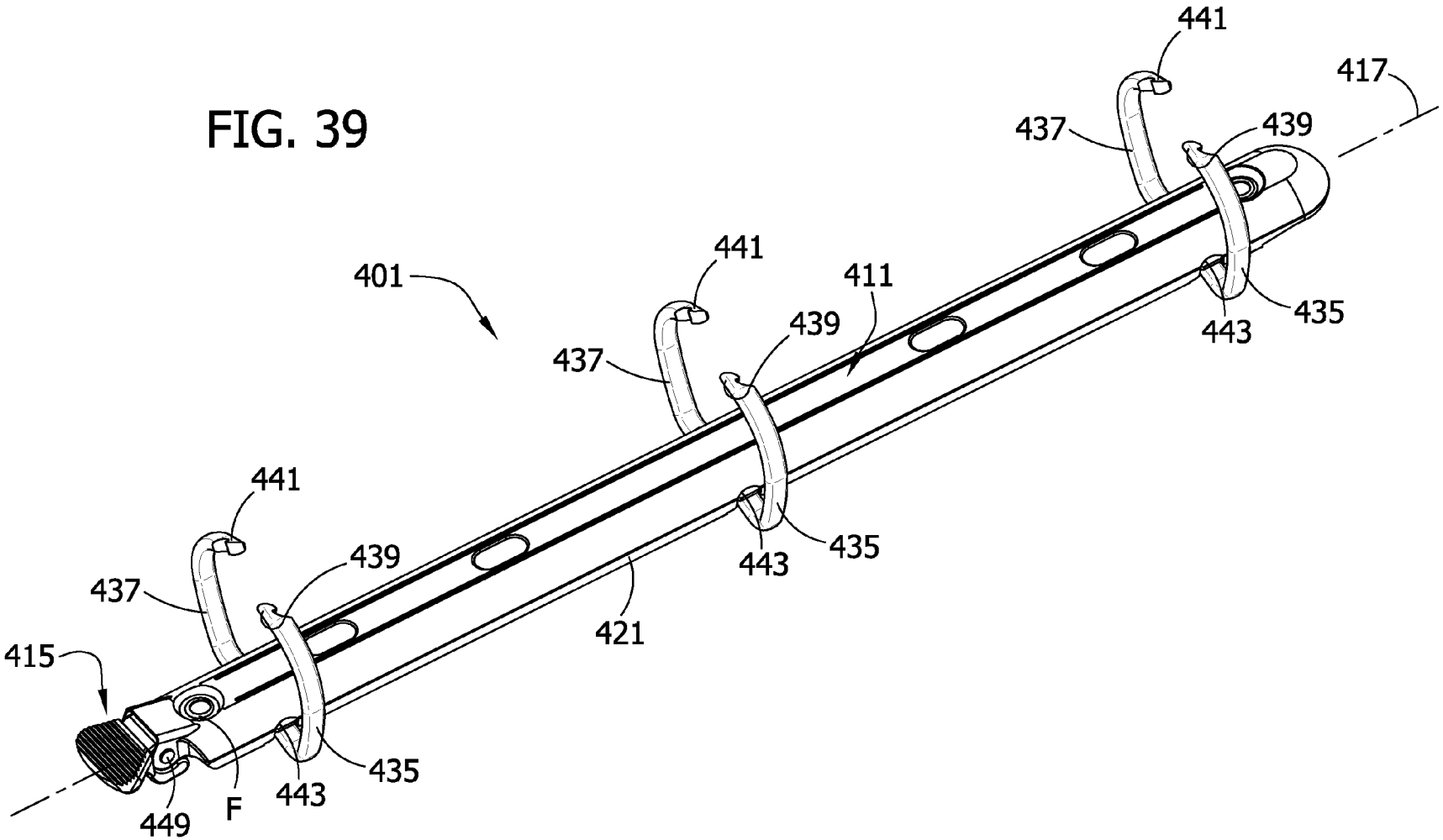
FIG. 39 is a top perspective similar to FIG. 37 but showing pivotal movement of first ring members relative to second ring members.
Figure 40:
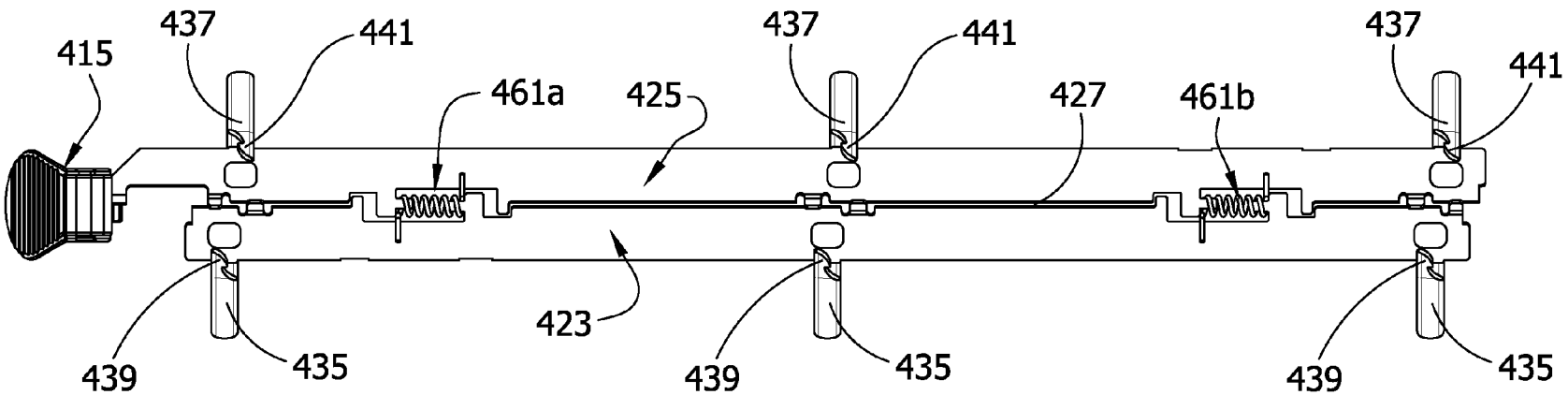
FIG. 40 is a top plan view similar to FIG. 38 but showing pivotal movement of the hinge plates as well as the pivotal movement of the ring members.
Figure 41:
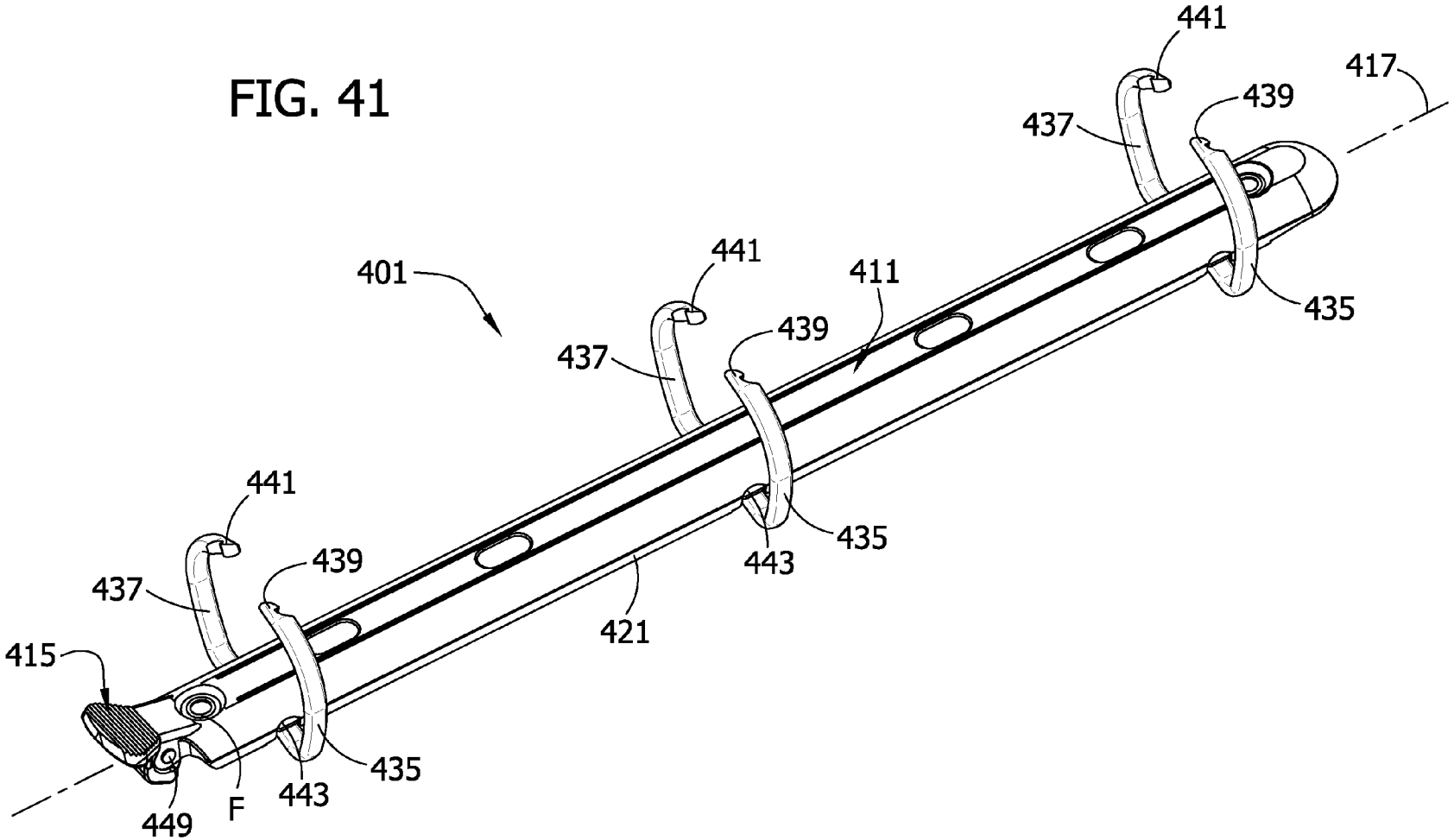
FIG. 41 is a top perspective similar to FIG. 39 but showing the mechanism with the ring members in an opened position.
Figure 42:
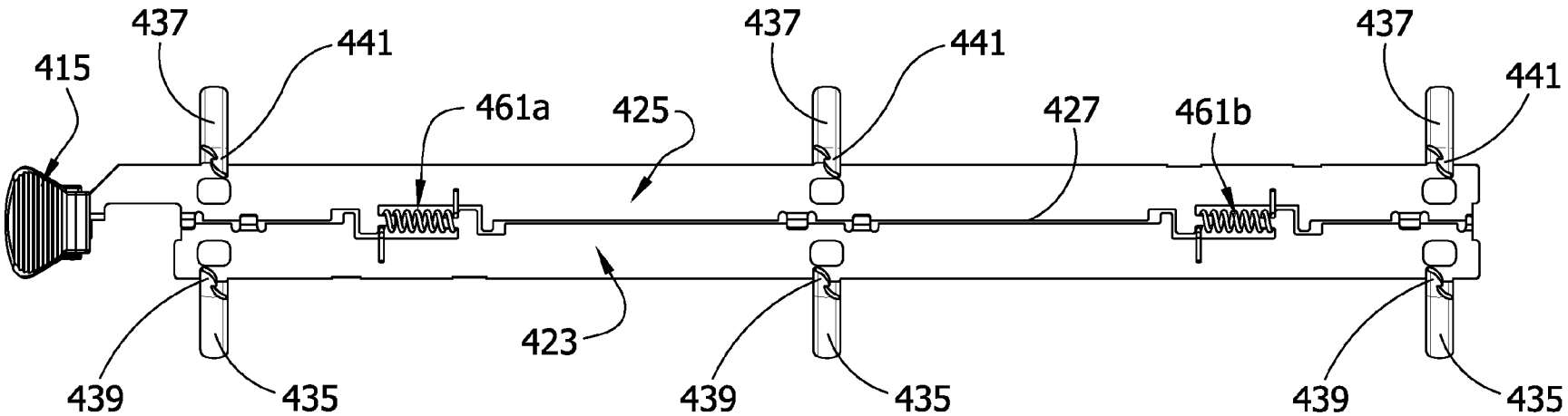
FIG. 42 is a top plan view similar to FIG. 40 but showing the location of the hinge plates in the opened position of the mechanism.

FIGS. 32 and 33 illustrate a fourth embodiment of the invention. The ring mechanism of this embodiment is indicated generally at 301, and is similar to the mechanism 1 of the first embodiment. Parts of this mechanism corresponding to parts of the mechanism 1 of the first embodiment are indicated by the same reference numbers, plus "300". In this embodiment, a lever 315 is removed. First ring members 335 are manually engaged for movement in a longitudinal direction to disengage interlocking ring members 335, 337. More specifically, in this embodiment one hand can be used to grasp one of the first ring members 335 and slide it in a direction to disengage all interlocking hook-shaped formations 339, 341 of the ring members 335, 337. The connection between the grasped first ring member 335 and the first hinge plate 323 causes the hinge plate to slide and move all of the first ring members 335 in the longitudinal direction to disengage their hook-shaped formations 339, 341.

FIGS. 34-42 illustrate a fifth embodiment of a ring binder mechanism, indicated generally at 401, of the present invention, which is similar to that of the third embodiment (FIGS. 24-29). Parts of this mechanism 401 corresponding to parts of the mechanism 1 of FIGS. 1-13 are indicated by the same reference numbers, plus "400". The ring mechanism 401 of this embodiment differs from the previous embodiments in that a lever 415 is a low profile lever and is mounted at an end of a housing 411. The low profile lever 415 extends only slightly above the top of the housing 411 and because it is located at the end of the housing it does not interfere with the movement of loose-leaf pages along ring members 435, 437. The illustrated lower profile lever 415 is particularly useful with relatively short ring members 435, 437 (e.g., 0.5-inch diameter) but it is understood that the lever could be used with ring members of various sizes and/or configurations.

In this embodiment, hinge plates 423, 425 pivot through a co-planar position when the ring members 435, 437 open and close. So as the hinge plates 423, 425 pass through the co-planar position, the spring force of the housing 411 urges the hinge plates to pivot away from the coplanar position, either downward (away from the housing) for closing the ring members 435, 437 or upward (toward the housing) for opening the ring members. When the ring members 435, 437 are closed, the housing spring force resists pivoting movement of the hinge plates 423, 425 upward and holds the ring members from opening (even after the first hinge plate 423 slides longitudinally to disengage hook-shaped formations 439, 441 of the ring members 435, 437).

In this embodiment, to open the ring members 435, 437, actuation of the lever 415 first slides the first hinge plate 423 longitudinally for disengaging the ring members 435, 437 and then pushes upward on the first hinge plate, moving the interconnected hinge plates 423, 425 through the co-planar position for opening the ring members. More specifically, a lower arm of the lever 415 contacts the lower surface of the hinge plates 423, 425 (see FIG. 35) and pivots the hinge plates upward through the co-planar position against the spring force of the housing 411 for opening the ring members 435, 437 after sliding the first hinge plate 423 longitudinally.

Compression springs 461*a*, 461*b* are located in cutouts along a central hinge 427 of the hinge plates 423, 425 in the same manner as described above with respect to the third embodiment (FIGS. 24-29). Operation of the mechanism 401 is the substantially the same as the operation of the mechanisms previously described.

It is understood that the variations described herein can be applied to each of the different embodiments disclosed. While it has been described that a first hinge plate is slidable and a second hinge plate is held against sliding movement, the second hinge plate could be slidable and the first hinge plate held against sliding movement within the scope of the invention. In addition, although in the illustrated mechanisms both ring members can move, mechanisms having one movable ring member and one fixed do not depart from the scope of the invention.

Components of the mechanism of the present invention are made of a suitable material, such as metal (e.g., steel). But mechanisms made of a non-metallic material, specifically including plastic, do not depart from the scope of this invention.

When introducing elements of the invention, the articles "a", "an", "the" and "said" are intended to mean that there are one or more of the elements. The terms "comprising", "including" and "having" and variations thereof are intended to be inclusive and mean that there may be additional elements other than the listed elements. Moreover, the use of orientation terms such as "front" and "back" is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring binder mechanism for retaining loose-leaf pages, the mechanism comprising:

a housing having a longitudinal axis;

first and second hinge plates supported by the housing along a hinge for pivoting movement relative to the housing about the hinge;

rings for holding loose-leaf pages, each ring including a first ring member and a second ring member, the first ring member being mounted on the first hinge plate and moveable with the pivoting motion of the first hinge plate relative to the second ring member between a closed position and an opened position, in the closed position a free end of the first ring member joining with a free end of the second ring member, and in the opened position the free end of the first ring member separating from the free end of the second ring member;

an interlocking formation for locking the first ring member and second ring member of each ring in the closed position;

an actuator mounted on the housing for movement relative to the housing, the actuator being adapted to pivot the first and second hinge plates by applying an upward force to at least one of the hinge plates and to translate the first hinge plate relative to the second hinge plate in a direction substantially parallel to the longitudinal axis of the housing, wherein the first hinge plate moves in a first longitudinal direction when disengaging the interlocking formation, the ring binder mechanism further comprising a spring operatively connected to the hinge plates for urging the first hinge plate to move in a second longitudinal direction opposite the first longitudinal direction.

2. A ring binder mechanism as set forth in claim 1 wherein the actuator is pivotally mounted on the housing at a longitudinal end thereof.

3. A ring binder mechanism as set forth in claim 2 wherein the actuator is a low profile lever.

4. A ring binder mechanism as set forth in claim 1 wherein the actuator includes an arm for contacting a lower surface of the first hinge plate.

5. A ring binder mechanism as set forth in claim 1 wherein the actuator is pivotally mounted on the housing between longitudinal ends of the housing.

6. A ring binder mechanism as set forth in claim 5 wherein the housing comprises an upstanding tab, the actuator being pivotally connected to the tab.

7. A ring binder mechanism as set forth in claim 1 wherein the actuator comprises first and second arms, the first arm being positioned generally above the housing and the second arm extending below the housing into a position in opposition to the underside of the first hinge plate for engaging the first hinge plate.

8. A ring binder mechanism as set forth in claim 1 wherein the longitudinal movement of the first hinge plate moves the first ring members and disengages the interlocking formation, the second hinge plate being held against movement in said longitudinal direction.

9. A ring binder mechanism as set forth in claim 1 wherein the housing is constructed to hold the second hinge plate against translational movement in said direction.

10. A ring binder mechanism as set forth in claim 1 wherein the housing biases the first and second hinge plates toward the opened position when the ring members are in the opened position.

11. A ring binder mechanism as set forth in claim 10 wherein the housing biases the first and second hinge plates toward the closed position when the ring members are in the closed position.

12. A ring binder mechanism as set forth in claim 10 wherein the hinge plates do not pass through a co-planar position during their pivoting movement.

13. A ring binder mechanism as set forth in claim 1 wherein the hinge plates each include a cutout for receiving at least part of the spring.

14. A ring binder mechanism as set forth in claim 13 wherein the spring is a compression spring.

15. A ring binder mechanism as set forth in claim 1 wherein the interlocking formation comprises hook-shaped formations on the free ends of the first ring members and interlocking hook-shaped formations on the free ends of the second ring members.

* * * * *